US007663654B2

(12) United States Patent
Arai et al.

(10) Patent No.: US 7,663,654 B2
(45) Date of Patent: Feb. 16, 2010

(54) IMAGE FORMATION DEVICE AND METHOD FOR CORRECTING PERIODIC VARIATIONS

(75) Inventors: Yasuhiro Arai, Kanagawa (JP); Kenji Koizumi, Kanagawa (JP); Kazuhiro Hama, Kanagawa (JP); Toshio Hisamura, Kanagawa (JP); Toshiki Matsui, Kanagawa (JP); Kozo Tagawa, Kanagawa (JP); Yoshiki Matsuzaki, Kanagawa (JP); Ryo Ando, Kanagawa (JP); Tsutomu Udaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 472 days.

(21) Appl. No.: 11/481,963

(22) Filed: Jul. 7, 2006

(65) Prior Publication Data

US 2007/0120939 A1 May 31, 2007

(30) Foreign Application Priority Data

Nov. 25, 2005 (JP) ..... 2005-340650

(51) Int. Cl.
*B41J 2/385* (2006.01)
*G03G 15/00* (2006.01)

(52) U.S. Cl. ..... 347/132; 399/49

(58) Field of Classification Search ..... 347/132, 347/133, 144, 112, 115, 116, 117, 118, 129, 347/130, 131, 135, 253, 246, 251, 252, 254; 399/49, 51, 60, 72

See application file for complete search history.

(56) References Cited

U.S. PATENT DOCUMENTS 5,907,344 A * 5/1999 Tanimoto et al. ..... 347/131
6,750,892 B2 * 6/2004 Suzuki ..... 347/133
7,058,325 B2 * 6/2006 Hamby et al. ..... 399/49
7,489,884 B2 * 2/2009 Ichikawa et al. ..... 399/49

FOREIGN PATENT DOCUMENTS

| | | |
|---|---|---|
| JP | A-10-181082 | 7/1998 |
| JP | A-11-014920 | 1/1999 |
| JP | 2000-89540 A | 3/2000 |
| JP | A-2000-238330 | 9/2000 |
| JP | A-2001-281589 | 10/2001 |
| JP | 2002-91116 A | 3/2002 |

(Continued)

*Primary Examiner*—Stephen D Meier
*Assistant Examiner*—Rene Garcia, Jr.
(74) *Attorney, Agent, or Firm*—Morgan, Lewis & Bockius LLP

(57) ABSTRACT

An image-forming device which is equipped with an image-holding member, an exposure section provided with plural light-emitting portions arranged in a first direction, a movement section that relatively moves the exposure section and the image-holding member in a second direction that intersects with the first direction, and a light-emission control section. The light-emission control section causes the plural light-emitting portions to periodically emit light in accordance with image data representing an image that is to be formed on the image-holding member, to form the image on the image-holding member. The light-emission control section varies a light-emission period during formation of the image, so as to correct for periodic fluctuations within the image of at least one of density and magnification ratio in the second direction.

25 Claims, 14 Drawing Sheets

FOREIGN PATENT DOCUMENTS

| | | | | |
|---|---|---|---|---|
| JP | 2004-191600 | A | | 7/2004 |
| JP | 2004191600 | A | * | 7/2004 |
| JP | 2005-10569 | A | | 1/2005 |
| JP | 2005-88420 | A | | 4/2005 |
| JP | 2005-131961 | A | | 5/2005 |
| JP | A-2005-193615 | | | 7/2005 |

* cited by examiner

FIG. 5A

AN EXAMPLE OF A DIFFERENCE BETWEEN SUB-SCANNING LENGTHS OF IMAGES FORMED AT TWO SIDES OF A RECORDING MEDIUM

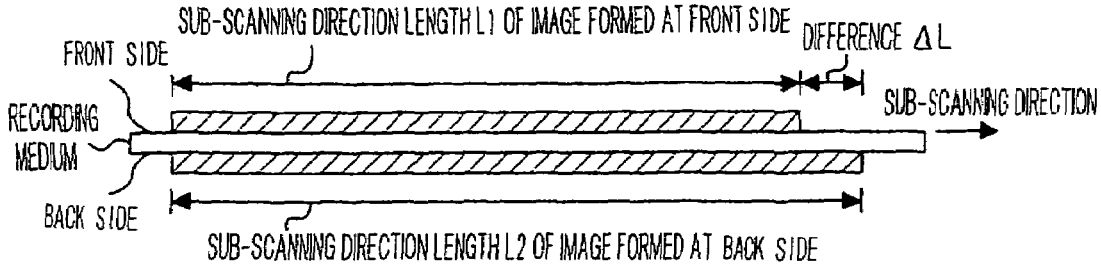

FIG. 5B

A CASE IN WHICH THE FRONT SIDE LIGHT-EMISSION PERIOD IS NOT CORRECTED AND THE BACK SIDE LIGHT-EMISSION PERIOD IS CORRECTED BY L1/L2

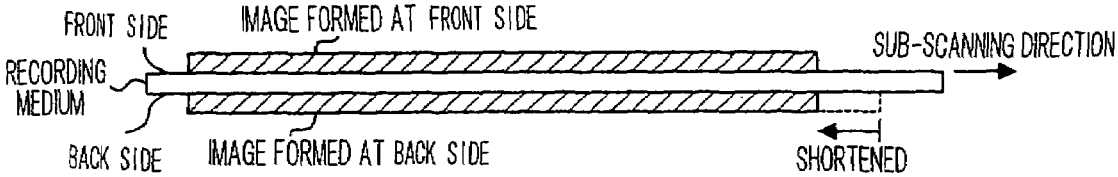

FIG. 5C

A CASE IN WHICH THE FRONT SIDE LIGHT-EMISSION PERIOD IS CORRECTED BY L2/L1 AND THE BACK SIDE LIGHT-EMISSION PERIOD IS NOT CORRECTED

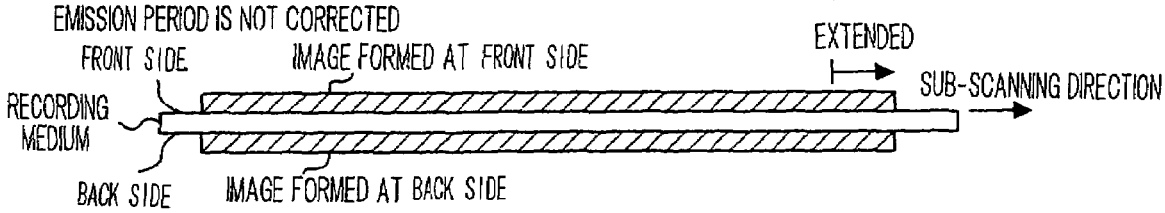

FIG. 5D

A CASE IN WHICH THE FRONT SIDE LIGHT-EMISSION PERIOD IS CORRECTED BY Lref/L1 AND THE BACK SIDE LIGHT-EMISSION PERIOD IS CORRECTED BY Lref/L2

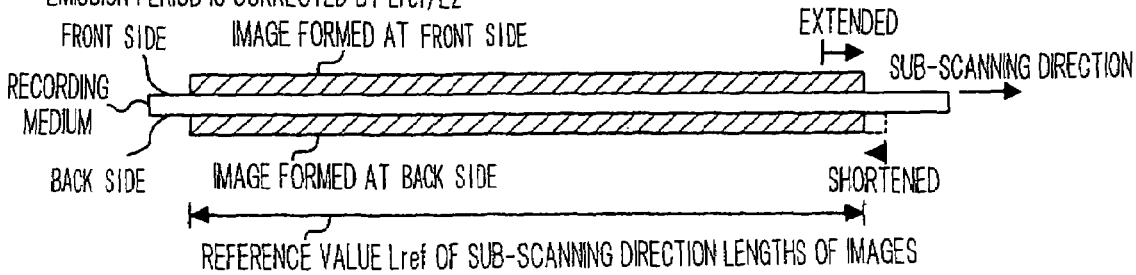

WITHOUT VARIATIONS OF DENSITY/ MAGNIFICATION

WITH VARIATIONS OF DENSITY (NO CORRECTION)

LIGHT-EMISSION PERIOD CORRECTION IMPLEMENTED

APPEARS FREE OF VARIATIONS IN DENSITY

EXAMPLES OF CORRECTION DATA FOR RESPECTIVE SCREEN TYPES

IMAGE FORMATION DEVICE AND METHOD FOR CORRECTING PERIODIC VARIATIONS

BACKGROUND

1. Technical Field

The present invention relates to an image formation device and method, and more particularly to an image formation device which includes an exposure section provided with plural light-emitting portions, which are arranged in a first direction, and a method for operating such a device.

2. Related Art

In an image formation device which forms images with an electrophotographic system, because of periodic variations in peripheral velocity of a photosensitive body which serves as an image-holding member, due to eccentricity of the photosensitive body, and/or changes over time of various portions of the device, there are possibilities in that periodic variations in density along a sub-scanning direction of images that are formed on the photosensitive body, periodic variations in a scaling factor (magnification) along the sub-scanning direction and suchlike arise. Among the changes over time of portions of the device, for example, changes in thickness of a surface layer of the photosensitive body, changes over time in development and processing characteristics, changes over time in transfer efficiency, and the like can be considered.

SUMMARY

An aspect of the present invention is an image formation device including: an image-holding member that an image is formed thereon; an exposure section, that includes plural light-emitting portions arranged in a first direction; a movement section, that moves the exposure section and the image-holding member relative to one another in a second direction, that intersects the first direction; and a light-emission control section which causes the plural light-emitting portions of the exposure section to periodically emit light in accordance with image data, which represents the image that is to be formed on the image-holding member, and causes the image to be formed on the image-holding member, the light-emission control section altering a light-emission period of the plural light-emitting portions during formation of the image so as to correct periodic variations in the image of at least one of density and magnification ratio along the second direction.

BRIEF DESCRIPTION OF THE DRAWINGS

Exemplary embodiments of the present invention will be described in detail based on the following figures, wherein:

FIGS. 5A, 5B, 5C and 5D are image views for explaining setting of light-emission period correction values for correcting magnification ratio variations of a front and back side of a recording medium;

DETAILED DESCRIPTION

Figure 1:
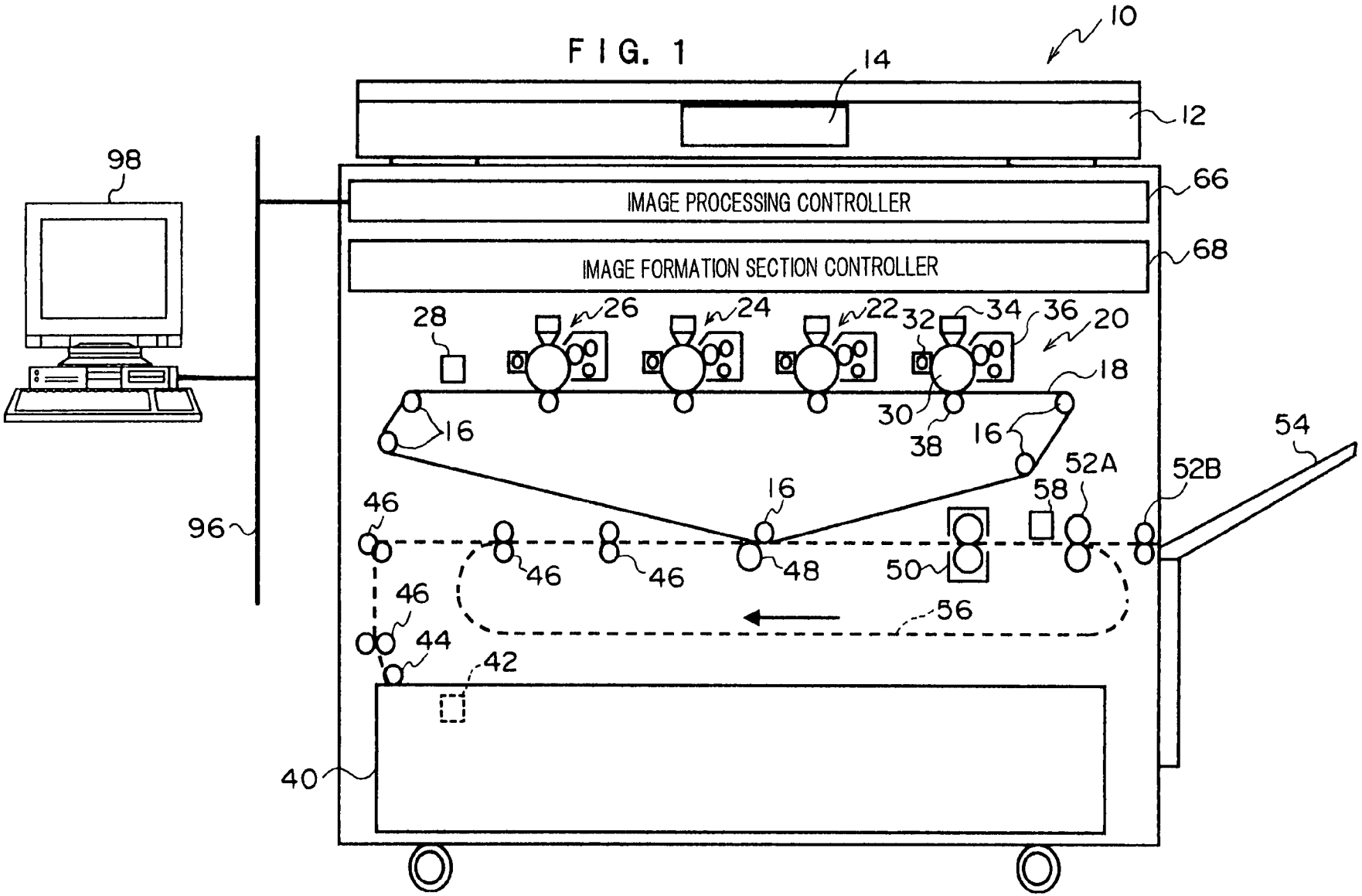
FIG. 1 is a schematic structural diagram of an image formation device relating to an exemplary embodiment.

Herebelow, an exemplary embodiment of the present invention will be described in detail with reference to the drawings. An image formation device 10 relating to this exemplary embodiment is shown in FIG. 1. The image formation device 10 is connected with plural client terminals 98, constituted by personal computers (PCs) or the like, via a network 96, such as a LAN or the like, and is provided with an original-reading apparatus 12, which scanningly reads an original placed on a platen glass. Accordingly, a printer function, for transferring and forming an image represented by data that has been received from the client terminals 98 through the network 96 (data described in, for example, a page description language) on a recording medium such as paper or the like, and a photocopier function, for transferring and forming an image represented by data that has been obtained by the original-reading apparatus 12 reading the original on the recording medium, are provided in combination. Herein, a control panel 14, which is structured to include a display which displays messages and the like and a keyboard which enables input of various commands and the like, is provided at an upper portion of the image formation device 10. The original-reading apparatus 12 performs original-reading in accordance with instructions inputted from the control panel 14.

The image formation device 10 is equipped with an endless intermediate transfer belt 18, which is wound between plural driving rollers 16. The intermediate transfer belt 18 is driven to move, to turn in an anti-clockwise direction of FIG. 1, by the driving rollers 16. At an upper side of the intermediate transfer belt 18, an image formation section 20 which forms yellow toner images, an image formation section 22 which forms magenta toner images, an image formation section 24 which forms cyan toner images, an image formation section 26 which forms black toner images, and a CCD sensor 28 are provided in order along a direction of turning conveyance of the intermediate transfer belt 18. Because the image formation sections 20 to 26 have substantially identical structures, matching reference numerals will be applied to various portions thereof, and only the image formation section 20 will be described herebelow.

Figure 2:
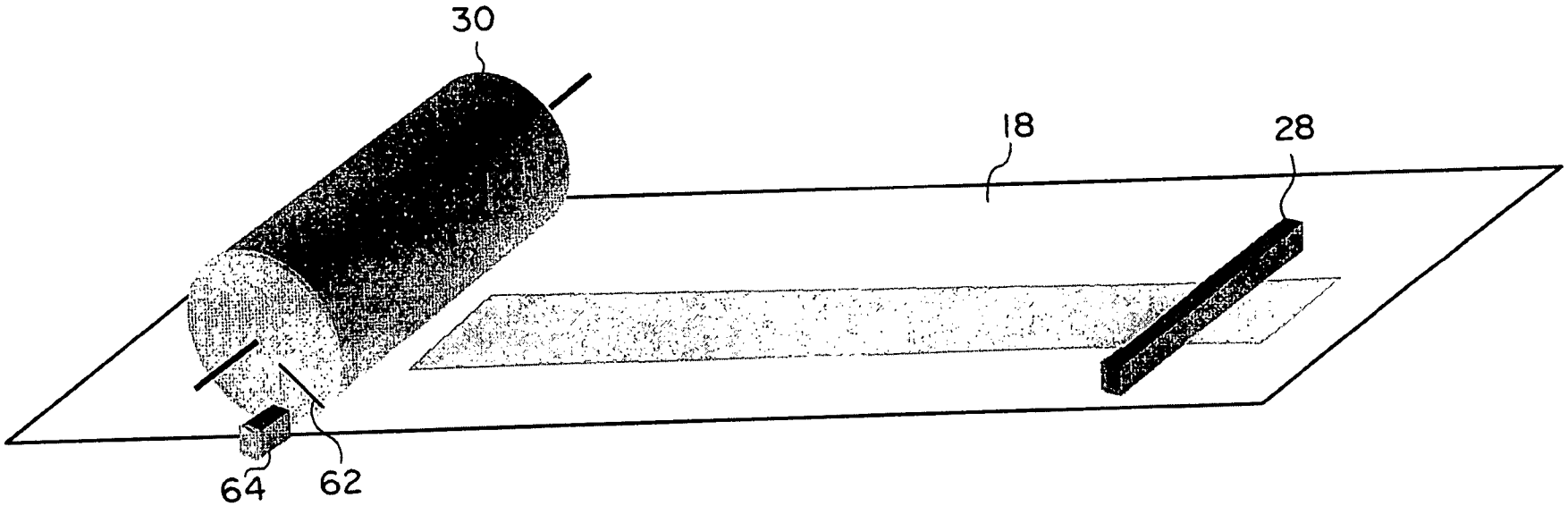
FIG. 2 is a perspective view showing disposition of a rotation position sensor and a density sensor.

The image formation section 20 is provided with a photosensitive drum 30 in a substantially cylindrical form, which is rotatable about an axis thereof and is disposed such that an outer peripheral surface thereof makes contact with the intermediate transfer belt 18. The photosensitive drum 30 corresponds to an image-holding member relating to the present invention, and is turned in the clockwise direction of FIG. 1 by a photosensitive drum driving section 60 (see FIG. 3). The photosensitive drum driving section 60 corresponds to a movement section relating to the present invention. As shown in FIG. 2, a mark 62 is applied to a side face of the photosensitive drum 30, at a particular position along the circumferential direction of the photosensitive drum 30. At a position from which the mark 62 can be optically detected, a rotation position detection sensor 64 is provided, for detecting a position of the photosensitive drum 30 in a rotation direction (a rotation position). The rotation position detection sensor 64 is connected to a CPU 72 via a signal processing circuit 70 of an image formation section controller 68 (see FIG. 3; to be described in more detail later). The CPU 72 performs signal processing, such as frequency dividing and the like, on signals inputted from the rotation position detection sensor 64, and thus generates rotation position signals with which the CPU 72 can identify current rotation positions of the photosensitive drum 30, and outputs these rotation position signals to the CPU 72.

At an outer periphery of the photosensitive drum 30, a charger 32 is provided, which electrostatically charges the outer peripheral surface of the photosensitive drum 30 to a predetermined potential. At a downstream side of the charger 32 in the direction of rotation of the photosensitive drum 30, an exposure head 34 is provided, which illuminates light beams at the charged peripheral surface of the photosensitive drum 30 to form an electrostatic latent image. The exposure head 34 corresponds to an exposure section relating to the present invention. The exposure head 34 is formed by numerous LEDs, which serve as light-emitting portions, being arranged in a row. The exposure head 34 is disposed to be spaced apart from the photosensitive drum 30 with a direction of arrangement of the LEDs being parallel to the axis of the photosensitive drum 30 (i.e., a main scanning direction of the electrostatic latent image formed on the peripheral surface of the photosensitive drum 30, which is a first direction). A SELFOC® lens array (not shown), which is supported at a bracket (not shown), is disposed at a light beam emission side of the LEDs. The light beams emitted from the individual LEDs pass through the SELFOC® lens array and are irradiated to mutually different positions on the peripheral surface of the photosensitive drum 30.

Output image data for yellow is provided in units of single lines to the exposure head 34 from the image formation section controller 68, which will be described later. On the basis of this output image data, LEDs of the exposure head 34 repeatedly emit light with a period which is synchronized by an exposure period signal (synchronization signal), which will be described later. The LEDs that are to emit light in each light-emission period are selected in accordance with the output image data. In each light-emission cycle, the LEDs of the exposure head 34 expose and record an electrostatic latent image corresponding to one line on the peripheral surface of the photosensitive drum 30. Meanwhile, the photosensitive drum 30 is driven to rotate in a certain direction to implement sub-scanning. Thus, an electrostatic latent image of an image represented by the output image data is exposed and recorded on the peripheral surface of the photosensitive drum 30.

Also at the outer periphery of the photosensitive drum 30, a developing apparatus 36, a transfer section 38 and a cleaning apparatus (not illustrated) are disposed in order along the direction of rotation of the photosensitive drum 30, at the downstream side from the exposure head 34. The developing apparatus 36 forms a toner image on the peripheral surface of the photosensitive drum 30 by providing yellow toner to portions at which the electrostatic latent image has been formed on the peripheral surface of the photosensitive drum 30. The transfer section 38 transfers the toner image formed on the peripheral face of the photosensitive drum 30 onto a belt surface of the intermediate transfer belt 18. The cleaning apparatus is for removing toner that is left on the photosensitive drum 30. Thus, at the image formation section 20, the electrostatic latent image formed on the peripheral surface of the photosensitive drum 30 is developed with yellow toner, and after this yellow toner image has been formed at the peripheral surface of the photosensitive drum 30, the yellow toner image is transferred onto the belt surface of the intermediate transfer belt 18.

The other image formation sections 22, 24 and 26 also develop electrostatic latent images formed at the peripheral surfaces of the photosensitive drums 30 with toners of mutually different colors (magenta, cyan and black). After forming the toner image of the respective color at the peripheral surface of the photosensitive drum 30, each image formation section transfers the toner image onto the belt surface of the intermediate transfer belt 18 so as to be mutually superposed with any toner images of other colors that have already been transferred onto the belt surface of the intermediate transfer belt 18. Thus, a full-color toner image is formed on the belt surface of the intermediate transfer belt 18. The CCD sensor 28 is connected to the CPU 72 via the signal processing circuit 70 of the image formation section controller 68. The CCD sensor 28 senses densities of this toner image on the belt surface of the intermediate transfer belt 18, and outputs detection results to the CPU 72. The CCD sensor 28 is shown in FIG. 2 as a line sensor arranged along a width direction of the intermediate transfer belt, but is not limited thus. The CCD sensor 28 can use other structures, as long as such structures are at least capable of detecting densities of the toner image that has been transferred onto the belt surface of the intermediate transfer belt 18 at positions along the sub-scanning direction (i.e., the direction of movement of the intermediate transfer belt 18).

A tray 40 is provided downward of a position at which the intermediate transfer belt 18 is disposed. The tray 40 accommodates numerous sheets of a recording medium in a stacked state. A recording medium sensor 42 (see FIG. 3) is provided at the tray 40. The recording medium sensor 42 senses a size and type of recording mediums accommodated in the tray 40. The recording medium sensor 42 is connected to the CPU 72 via the signal processing circuit 70 of the image formation section controller 68, and outputs detection results of the size and type of the recording mediums to the CPU 72. A sheet of recording medium accommodated in the tray 40 is fed from the tray 40 in accordance with rotation of a feed roller 44, and the recording medium is conveyed by plural conveyance rollers 46 toward a transfer position (a position at which the driving roller 16 that is disposed furthest downward and a transfer roller 48 are disposed to oppose one another and sandwich the intermediate transfer belt 18). Then, the recording medium that has been conveyed to the transfer position is nipped between the transfer roller 48 and the intermediate transfer belt 18, and thus the full-color toner image that has been formed on the belt surface of the intermediate transfer belt 18 is transferred thereto. The recording medium to which the toner image has been transferred is conveyed to a fixing apparatus 50. A fixing treatment is implemented by the fixing apparatus 50 to fix the toner image, after which the recording medium is ejected to an ejection tray 54 outside the machine by conveyance roller pairs 52A and 52B.

A recording medium-inversion conveyance path 56 is provided above the tray 40, and a recording medium-inversion apparatus (not illustrated) is disposed partway along this recording medium-inversion conveyance path 56. A recording medium for which image recording is to be performed on both sides is fed into the recording medium-inversion conveyance path 56 from between the conveyance roller pair 52A and the conveyance roller pair 52B, is inverted front-to-back by the recording medium-inversion apparatus, and is then conveyed back to the transfer position. Then, a toner image is transferred to a back side of the recording medium at the transfer position, the toner image that has been transferred to the back side is fixed by the fixing apparatus 50, and the recording medium is ejected to the ejection tray 54. Further, an image sensor 58 is disposed at a downstream side of the fixing apparatus 50 with respect to the conveyance direction of the recording medium. The image sensor 58 is capable of sensing an image which has been transferred and fixed to the recording medium. The image sensor 58 is connected to the CPU 72 via the signal processing circuit 70 of the image formation section controller 68, and outputs detection results of images that have been transferred and fixed to recording mediums to the CPU 72.

Figure 3:
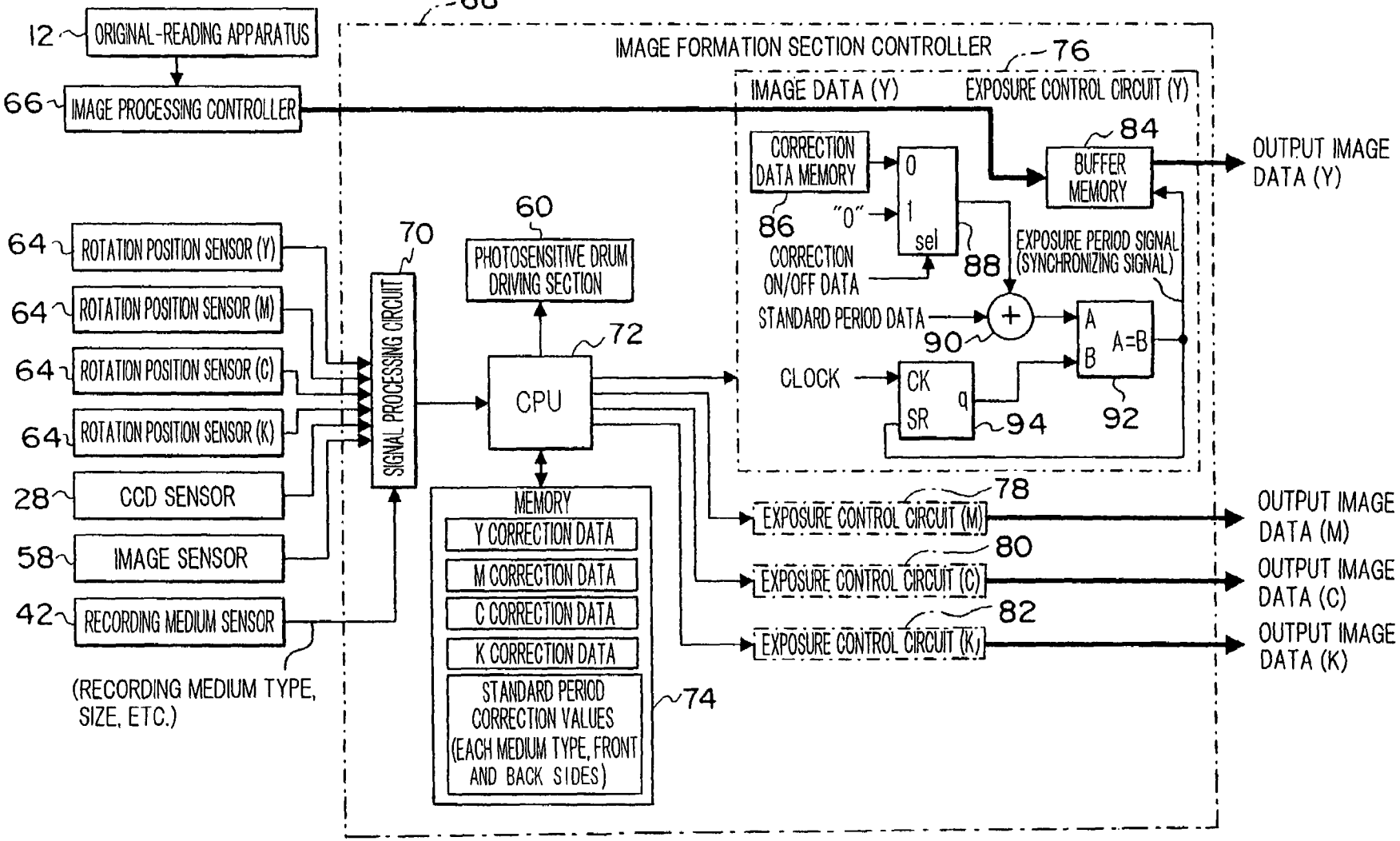
FIG. 3 is a block diagram showing schematic structure of an image formation section controller.

As shown in FIG. 1, the image formation device 10 is further equipped with an image processing controller 66 and the image formation section controller 68. The image processing controller 66 is provided with functions for sending and receiving data to and from the client terminals 98 via the network 96, and is connected with the original-reading apparatus 12, as is shown in FIG. 3. The image processing controller 66 performs image processing, such as color space conversion, gradation conversion, format conversion, compression/decompression, calibrations of gradation and density of the particular image formation device 10, binary conversion (screen processing) and the like, on data which has been received from the client terminals 98 through the network 96, data which has been obtained by reading an original with the original-reading apparatus 12 and inputted from the original-reading apparatus 12, and the like. The image processing controller 66 outputs the image-processed image data to the image formation section controller 68.

As shown in FIG. 3, a non-volatile memory 74, which is formed of a flash memory, an EEPROM or the like, and four exposure control circuits 76, 78, 80 and 82, which correspond to the image formation sections 20, 22, 24 and 26, are respectively connected with the CPU 72 of the image formation section controller 68. At a time of manufacture of the image formation device 10, correction data for each color and a standard period correction value (both to be described later) are respectively stored to the memory 74. The correction data for each color which has been stored in the memory 74 is periodically updated by correction data setting processing, which will be described later, and the standard period correction value is periodically updated by standard period correction value setting processing, which will be described later. In addition, programs for performing the above-mentioned processings and image formation processing (which will be described later) at the CPU 72 are stored at the memory 74 in advance.

Because the exposure control circuits 76 to 82 for the respective colors have mutually identical structures, the structure of the exposure control circuit 76 for yellow will be described as an example. The exposure control circuit 76 is equipped with a buffer memory 84 and a correction data memory 86. Image data for yellow is written to the buffer memory 84 by the image processing controller 66, and correction data for yellow is written to the correction data memory 86 by the CPU 72. A data output terminal of the correction data memory 86 is connected to one of two input terminals of a selector 88. A data zero, representing 'no correction', is constantly inputted to the other input terminal of the selector 88. Correction on/off data, representing whether or not to perform correction of a light-emission period of the exposure head 34, is inputted from the CPU 72 to a control signal input terminal of the selector 88. When the inputted correction on/off data is for 'correction on', the selector 88 outputs the correction data inputted thereto from the correction data memory 86, and when the on/off data is for 'correction off', the selector 88 outputs the data zero representing 'no correction'.

As will be described in more detail later, the correction data that is written to the correction data memory 86 is respectively set for each of positions along the rotation direction of the photosensitive drum 30. The individual correction data are stored in the correction data memory 86 at respective memory regions with addresses representing the positions that correspond to the individual correction data. An address terminal of the correction data memory 86 is connected with the CPU 72. On the basis of rotation position signals which are inputted from the rotation position detection sensor 64 via the signal processing circuit 70, the CPU 72 determines a position, of the positions in the rotation direction of the photosensitive drum 30, which corresponds to a position of exposure by the exposure head 34 of the image formation section 20, to which output image data is supplied from the exposure control circuit 76. The CPU 72 repeatedly processes for input of addresses representing the determined positions to the correction data memory 86. Thus, addresses inputted to the correction data memory 86 are sequentially changed in accordance with rotation of the photosensitive drum 30. Correction data corresponding to, of the positions along the rotation direction of the photosensitive drum 30, the position which is illuminated by the light beams from the exposure head 34 of the image formation section 20 is outputted from the correction data memory 86, and the correction data is sequentially changed in accordance with rotation of the photosensitive drum 30.

An output terminal of the selector 88 is connected to one of two input terminals of an adder 90. Data which is outputted from the output terminal of the selector 88 is inputted to the adder 90 to serve as a light-emission period correction value. Standard period data, representing a standard value of the light-emission period of the exposure head 34 of the image formation section 20, is inputted to the other input terminal of the adder 90. The adder 90 outputs data (a light-emission period value) in which the light-emission period standard value is added to the light-emission period correction value. An output terminal of the adder 90 is connected to one of two input terminals of a comparator 92, and the light-emission period value outputted from the adder 90 is inputted to the comparator 92. An output terminal of a counter 94 is connected to the other input terminal of the comparator 92. A clock signal with a certain frequency is inputted to a clock signal input terminal CK of the counter 94. A reset terminal SR of the counter 94 is connected with an output terminal of the comparator 92. The counter 94 counts pulses of the clock signal which is inputted through the clock signal input terminal CK, and outputs a count value to the comparator 92. The comparator 92 outputs a match signal (a pulse) when the values inputted through the two input terminals thereof match. This match signal is inputted to the reset terminal SR of the counter 94, and resets the count value that is held by the counter 94.

Thus, the match signal is outputted from the comparator 92 each time the count value that the counter 94 holds reaches the light-emission period value that is inputted from the adder 90. The output terminal of the comparator 92 is also connected to the buffer memory 84, and the match signal outputted from the comparator 92 is inputted to the buffer memory 84 to serve as an exposure period signal (i.e., synchronization signal). Each time the pulse serving as the exposure period signal (synchronization signal) is inputted from the comparator 92, the buffer memory 84 outputs data corresponding to one line to the exposure head 34 to serve as output image data. Accordingly, the LEDs of the exposure head 34 repeatedly emit light with a period which is synchronized by the exposure period signals (synchronization signals), that is, with a period corresponding to the light-emission period value which is inputted from the adder 90 to the comparator 92, and the LEDs that emit light in each cycle of the exposure period are selected in accordance with the output image data that is outputted from the buffer memory 84.

Figure 4A:
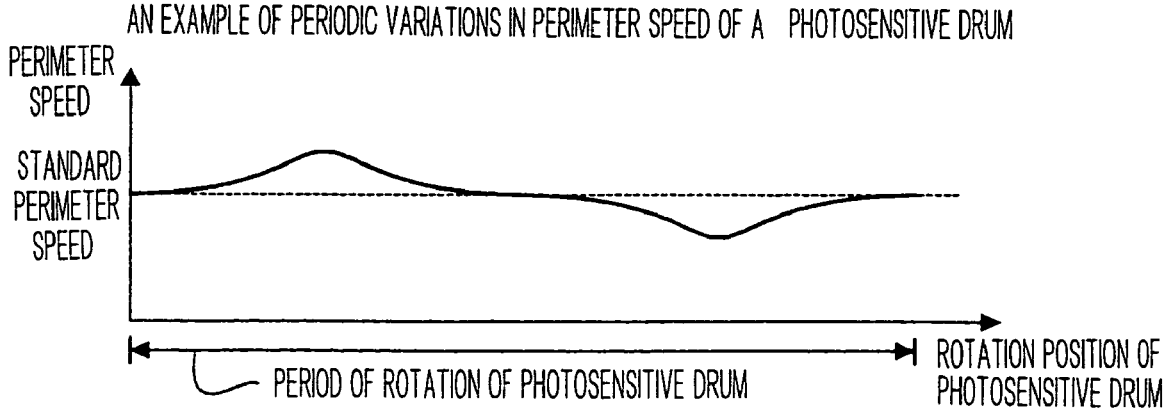
FIG. 4A is a graph showing an example of variations in perimeter speed of a photosensitive drum.
Figure 4B:
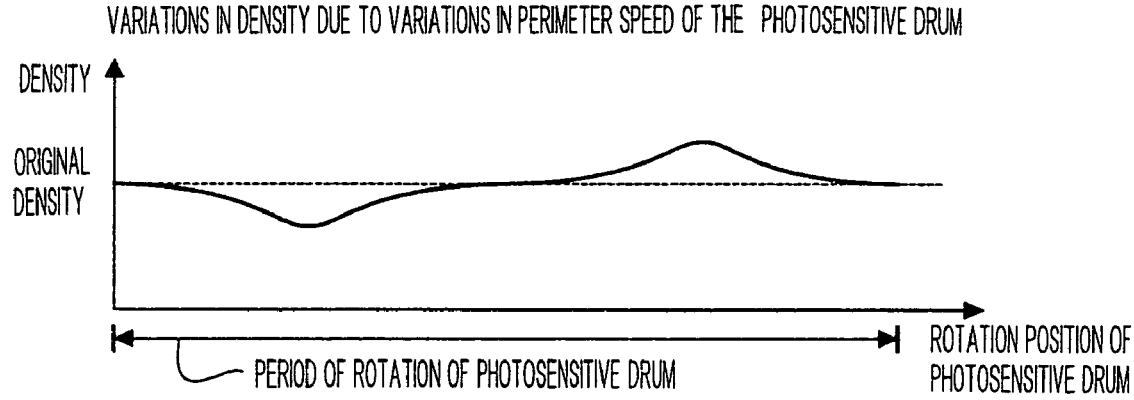
FIG. 4B is a graph showing an example of variations in density of an image.

Next, operations of this exemplary embodiment will be described. It is common for an eccentricity, inclination or the like of the rotation axis to occur at the photosensitive drum 30 of the image formation device 10, as a result of fabrication errors and the like. When the photosensitive drum 30 is driven to rotate, the perimeter speed thereof varies periodically because of the eccentricity, inclination or the like of the rotation axis of the photosensitive drum 30, with one rotation of the photosensitive drum 30 being one period (an example is shown in FIG. 4A). On the other hand, a light-emission period of the exposure head 34 is usually fixed. Therefore, movement distances of the peripheral surface of the photosensitive drum 30 at the exposure position, between one light-emission of the exposure head 34 and the next light-emission, vary during one rotation of the photosensitive drum 30. These variations become visible in an image which is formed on a recording medium as variations in density (and magnification) along the sub-scanning direction (an example of density variations in accordance with the variations in perimeter speed shown in FIG. 4A is shown in FIG. 4B). Furthermore, degrees of eccentricity and/or inclination of the rotation axes of the photosensitive drums 30 differ between the individual photosensitive drums 30. Accordingly, at a time of fabrication (prior to shipping) of the image formation device 10 relating to this exemplary embodiment, a correction data setting operation which is described below is carried out.

In this correction data setting operation, first, the photosensitive drum 30 of a particular image formation section is driven to rotate by the photosensitive drum driving section 60. In this state, variations in perimeter speed of the photosensitive drum 30 during one rotation are measured by a perimeter speed measurement device. The perimeter speed measurement device corresponds to a perimeter speed detection section of the present invention. Then, on the basis of the variations in perimeter speed of the photosensitive drum 30 which have been measured by the perimeter speed measurement device, light-emission period correction amounts (duration values) for making movement distances of the peripheral surface of the photosensitive drum 30 at the exposure position, in durations from one light-emission of the exposure head 34 to the next light-emission (i.e., over light-emission intervals), constant are calculated for respective positions along the direction of rotation of the photosensitive drum 30. Thus, as shown by the example in FIG. 4C, light-emission period correction amounts at the respective positions along the rotation direction of the photosensitive drum 30 are obtained. Here, in order to prevent a sub-scanning direction length of an image altering in accordance with corrections of the light-emission periods, the correction amounts obtained by the above-described operation are adjusted as necessary such that an average value thereof is zero. That is, adjustments are performed as necessary such that areas, in FIG. 4C, of a region at which the correction amounts are labeled positive relative to the standard period and an area at which the correction amounts are labeled negative are equal.

Then, by dividing the correction amounts provided by the above-described processing between periods of the clock signal that is inputted to the clock signal input terminal CK of the counter 94, correction data are respectively calculated for the respective positions along the direction of rotation of the photosensitive drum 30. The respective correction data which have been calculated are stored at the memory 74 in association with position information for identifying the corresponding positions, of the respective positions along the rotation direction of the photosensitive drum 30. The correction data setting operation described hereabove is performed for each of the photosensitive drums 30 of the individual image formation sections 20 to 26. Hence, as is shown in the example in FIG. 3, the correction data for correcting variations in density (magnification) along the sub-scanning direction within an image, which variations are caused by variations in perimeter speed of the photosensitive drums 30, are respectively stored for yellow, magenta, cyan and black at the memory 74.

A recording medium for which formation (transfer and fixing) of an image to one side has been completed by the image formation device 10 is heated during fixing processing by the fixing apparatus 50, and a size thereof becomes slightly smaller in comparison with the recording medium prior to fixing processing, because of evaporation of moisture content. Depending on the type of recording material, it is also possible for the size to become slightly larger in the fixing processing. Thus, in a case in which images are formed at both sides of a recording medium, an image that is transferred to a first side of the recording medium (the first side at which an image is formed; hereafter referred to as the front side) passes through the fixing processing twice before the recording medium is ejected from the image formation device 10, while an image which is transferred to a second side of the recording medium (a reverse side from the first side; below referred to as the back side) passes through the fixing processing once and then the recording medium is ejected from the image formation device 10. As a result, sizes of the image formed at the front side and the image formed at the back side of the recording medium that is ejected from the image formation device 10 may differ from one another.

Accordingly, in this exemplary embodiment, identical images are formed on the two sides of a recording medium of a particular type, and sub-scanning direction lengths of the images formed at the front side and the back side of the recording medium of the specific type (i.e., overall magnification ratios of the images in the sub-scanning direction) are respectively measured. Standard period correction amount setting processing, on the basis of a difference between the measured sub-scanning direction lengths, sets the correction amounts of the standard period of the exposure head 34 for the front side and the back side, respectively, of the recording medium of the particular type, such that sub-scanning direction lengths of images which will be formed at the front side and back side of recording mediums of the particular type will be equal. The standard period correction amount setting processing is performed in advance for each of types of recording medium. Hence, the standard period correction amounts which are set for the front side and back side of each type of recording medium by the above-described processing are stored at the memory 74 of the image formation device 10 prior to shipping, as shown in the example in FIG. 3.

The setting of the correction amounts for the standard period of the exposure head 34 can, for example, specify the correction amounts by reference to the sub-scanning direction length of an image which will be formed at the front side of the recording medium, such that the sub-scanning direction length of an image formed at the back side of the same recording medium will be equal to that reference. In such a case, a standard period correction amount for when an image is to be formed at the front side of a recording medium can be 0 (no correction), and a standard period correction amount for when an image is to be formed at the back side of the recording medium can be set such that the standard period is altered in accordance with a ratio of the sub-scanning direction length of the image that was formed at the front side to the sub-scanning direction length of the image that was formed at the back side. More specifically, as is shown in FIG. 5A as an example, if the sub-scanning direction length of the image that was formed at the front side of the recording medium is L1, the sub-scanning direction length of the image that was formed at the back side is L2, and a difference (L2−L1) is ΔL, then the standard period correction amount when an image is to be formed at the back side of a recording medium can be set such that the standard period after correction is L1/L2 times larger than the standard period before correction. Thus, as shown in FIG. 5B, the sub-scanning direction length of the image that is formed at the back side of the recording medium can be made to match the sub-scanning direction length of the image that is formed at the front side of the recording medium.

As another example, the standard period correction amounts can be set by reference to the sub-scanning direction length of an image which will be formed at the back side of a recording medium, such that the sub-scanning direction length of an image formed at the front side of the same recording medium will be equal to that reference. In such a case, a standard period correction amount when an image is to be formed at the back side of the recording medium is 0 (no correction). A standard period correction amount when an image is to be formed at the front side of the recording medium can be set such that this standard period is altered in accordance with a ratio of the sub-scanning direction length of the image that was formed at the back side to the overall sub-scanning direction length of the image that was formed at the front side. More specifically, for the example shown in FIG. 5A, the standard period correction amount when an image is to be formed at the front side of the recording medium can be set such that the standard period after correction is L2/L1 times larger than the standard period before correction. Thus, as shown in FIG. 5C, the sub-scanning direction length of the image that is formed at the front side of the recording medium can be made to match the sub-scanning direction length of the image that is formed at the back side of the recording medium.

As a further example, an original sub-scanning direction length (an absolute magnification) of the images that are to be formed at the front and back sides of the recording medium may serve as a reference value, and the standard period correction amounts when images are to be formed at the front side and the back side of a recording medium can be respectively set such that the sub-scanning direction lengths of the images that will be formed at the front side and the back side of the recording medium are respectively equal to that reference value. A standard period correction amount when an image is to be formed at the front side of a recording medium may be set such that the standard period for when the image is to be formed at the front side is altered in accordance with a ratio of the reference value to the overall sub-scanning direction length of the image that was formed at the front side. A standard period correction amount when an image is to be formed at the back side of the recording medium may also be set such that the standard period when the image is to be formed at the back side is altered in accordance with a ratio of the reference value to the overall sub-scanning direction length of the image that was formed at the back side. More specifically, for the example shown in FIG. 5A, if the above-mentioned reference value is Lref, then the standard period correction amount when an image is to be formed at the front side can be set such that the standard period after correction is Lref/L1 times larger than the standard period before correction, and the standard period correction amount when an image is to be formed at the back side can be set such that the standard period after correction is Lref/L2 times larger than the standard period before correction. Thus, as is shown in FIG. 5D, the sub-scanning direction length of an image that is formed at the front side of a recording medium can be made to match the sub-scanning direction length of an image that is formed at the back side of the recording medium.

Figure 6:
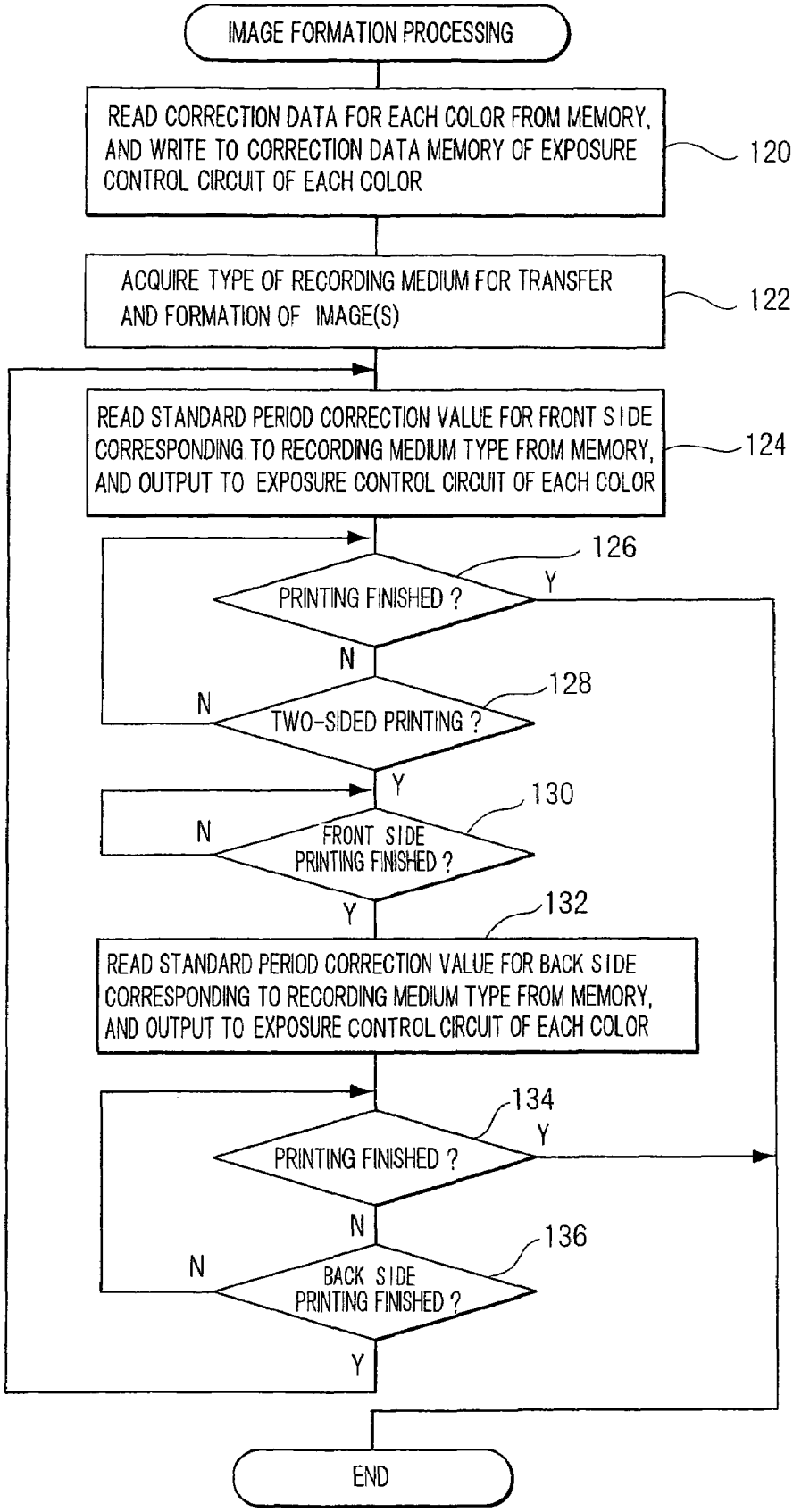
FIG. 6 is a flowchart showing details of image formation processing.

Next, image formation processing which is executed by the CPU 72 of the image formation section controller 68 when formation of (an) image(s) onto a recording medium is being performed by the image formation device 10 will be described with reference to the flowchart of FIG. 6. In this image formation processing, firstly, before image formation at the image formation sections 20 to 26, in step 120, correction data for each of the colors is read from the memory 74, the correction data for yellow that is read is written to the correction data memory 86 of the exposure control circuit 76, the correction data for magenta that is read is written to the correction data memory 86 of the exposure control circuit 78, the correction data for cyan that is read is written to the correction data memory 86 of the exposure control circuit 80 and the correction data for black that is read is written to the correction data memory 86 of the exposure control circuit 82. Here, the correction data that are written to the correction data memories 86 of the exposure control circuits 76 to 82 are collections of correction data for the respective positions along the rotation directions of the photosensitive drums 30. In each correction data memory 86, the correction data for the respective positions are written to respective storage regions with addresses representing the corresponding positions.

In step 122, the type of the recording medium accommodated at the tray 40, that is, of the recording medium at which the image(s) is/are to be formed, is acquired from the recording medium sensor 42. Then, in step 124, a front side standard period correction value corresponding to the recording medium type acquired in step 122 is read from the memory 74, standard period values which have been individually set beforehand are corrected by the front side standard period correction value that has been read from the memory 74, and the corrected standard period values are respectively outputted to the exposure control circuits 76 to 82 to serve as standard period data. This standard period data is inputted to the respective adders 90 of the exposure control circuits 76 to 82. When the above-described writing of correction data to the correction data memories 86 of the exposure control circuits 76 to 82 and outputting of standard period data to the exposure control circuits 76 to 82 are completed, instructions for image formation are sent to the exposure control circuits 76 to 82 and the image formation sections 20 to 26, and then the routine proceeds to step 126.

In step 126, it is judged whether or not printing (transfer and formation of an image onto the recording medium) has finished. If this judgement is negative, the routine proceeds to step 128, and it is judged whether or not image formation onto both sides of the recording medium has been instructed. If image formation onto one side of the recording medium has been instructed, this judgement is negative, the routine returns to step 126, and steps 126 and 128 are repeated until the judgement of step 126 is positive. However, if image formation onto both sides of the recording medium has been instructed, the routine proceeds to step 130, and it is judged whether or not image formation onto one side (the front side) of the recording medium has finished. Step 130 is repeated while this judgement is negative, until the judgement is positive.

Meanwhile, in parallel with the processing from step 126 onward, the CPU 72, on the basis of rotation position signals which are inputted from each rotation position detection sensor 64 via the signal processing circuit 70, determines which position, of the positions along the rotation direction of the photosensitive drum 30, corresponds with the position of exposure by the exposure head 34. The CPU 72 performs repeated processing for input of addresses representing determined positions to the correction data memory 86 for each of the exposure control circuits 76 to 82 (the image formation sections 20 to 26). Hence, correction data corresponding to, of the positions along the rotation directions of the photosensitive drums 30, the positions that are being illuminated by light beams from the exposure heads 34 of the image formation sections 20 to 26, are outputted from the correction data memories 86 of the exposure control circuits 76 to 82, and the correction data are sequentially altered in accordance with rotation of the photosensitive drums 30.

Figure 4C:
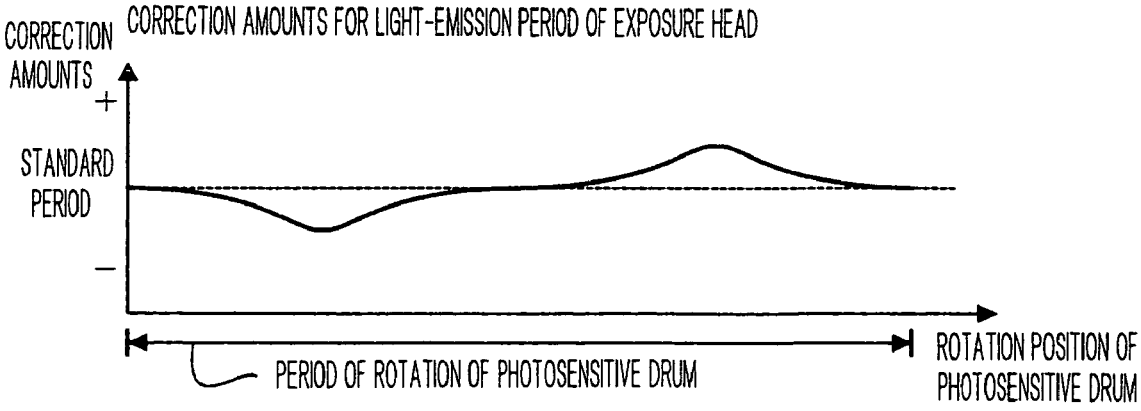
FIG. 4C is a graph showing an example of correction amounts to be applied to a light-emission period.

The CPU 72 also outputs respective data representing 'correction on' to the exposure control circuits 76 to 82 to serve as correction on/off data. Hence, at each of the exposure control circuits 76 to 82, the correction data outputted from the correction data memory 86 is inputted to the adder 90 via the selector 88 and then added to the standard period data which has been inputted from the CPU 72. The addition result is inputted to the comparator 92 to serve as the light-emission period value, and the LEDs of the exposure head 34 are repeatedly illuminated with a period corresponding to this light-emission period value. Further, the correction data outputted from the correction data memory 86 is altered sequentially (during image formation) in accordance with the rotation of the photosensitive drum 30. Thus, the light-emission period of the LEDs of the exposure head 34 is altered as shown in FIG. 4C over a duration in which the photosensitive drum 30 rotates once.

Figures 7A, 7B, 7C:
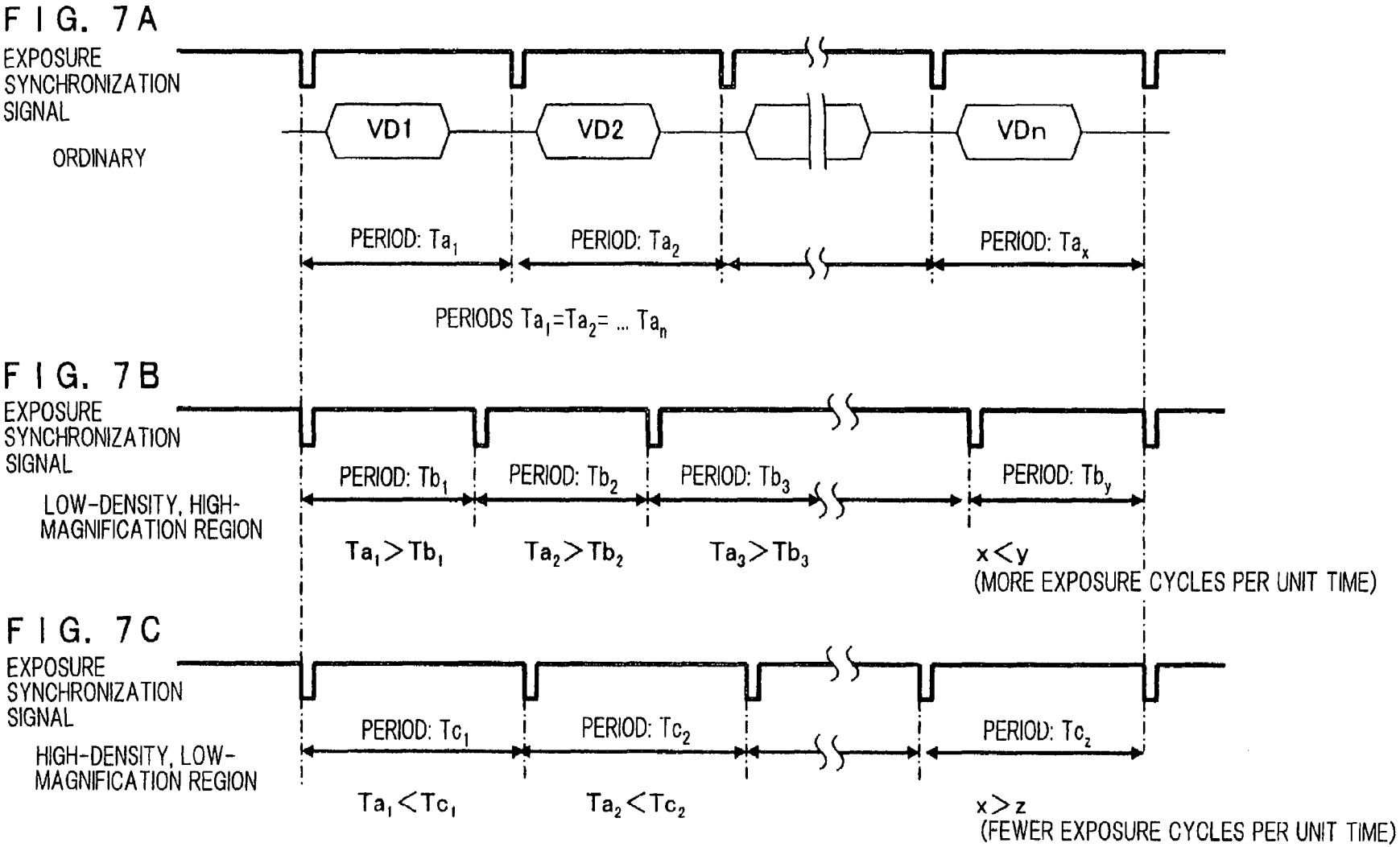
FIGS. 7A, 7B and 7C are timing charts showing exposure synchronization signals at, respectively, an ordinary region, a low-density, high-magnification region and a high-density, low-magnification region.

More specifically, when the light beams illuminated from the exposure head 34 are irradiated at a position, of the positions along the rotation direction of the photosensitive drum 30, at which the perimeter speed is increased (at which position a portion of exposure-recording would be visualized as a portion with low density and high magnification) the light-emission period is made shorter, as shown in FIG. 7B, than when the light beams illuminated from the exposure head 34 are irradiated at a position, of the positions along the rotation direction of the photosensitive drum 30, at which the perimeter speed matches a design value (see FIG. 7A). Conversely, when the light beams illuminated from the exposure head 34 are irradiated at, of the positions along the rotation direction of the photosensitive drum 30, a position at which the perimeter speed is reduced (at which position a portion of exposure-recording would be visualized as a portion with high density and low magnification), the light-emission period is made longer, as shown in FIG. 7C.

Therefore, regardless of periodic variations in perimeter speed of the photosensitive drum 30, spacings along the sub-scanning direction between the numerous main-scanning lines, which are formed on the peripheral face of the photosensitive drum 30 by cyclical illumination from the LEDs of the exposure head 34, will be constant. As a result, even if there is eccentricity, inclination or the like of the rotation axis of the photosensitive drum 30 because of fabrication errors and the like, periodic variations of the perimeter speed of the photosensitive drum 30 can be prevented from being expressed (visualized) as periodic variations in density/magnification along the sub-scanning direction within images which are formed by transfer onto the recording medium. Herein, the correction amounts which are regulated by the correction data outputted from the correction data memory 86 are adjusted as necessary such that the average value thereof is zero, as mentioned earlier. Consequently, a sub-scanning direction length of the image does not change even with the light-emission period being corrected on the basis of the above-described correction data, and is altered only in accordance with the standard period data inputted from the CPU 72.

If image formation onto one side of the recording medium (the front side only) has been instructed, then when image formation onto one side of an instructed number of sheets of the recording medium has finished, the judgement of step 126 is positive and the image formation processing ends. If image formation onto both sides of the recording medium (the front side and the back side) has been instructed, then when a time for carrying out image formation onto the back side of the recording medium is reached, the judgement of step 130 is positive and the routine proceeds to step 132. In step 132, a back side standard period correction value corresponding to the recording medium type acquired in step 122 is read from the memory 74, the standard period values which have been individually set beforehand are corrected with the standard period correction value read from the memory 74, and then the corrected standard period values are respectively outputted to the exposure control circuits 76 to 82 to serve as the standard period data.

In this manner, the light-emission periods of the LEDs of each exposure head 34 when an image is being formed for transfer and formation onto the back side of the recording medium are increased or reduced by amounts corresponding to a difference of the back side standard period correction value from the front side standard period correction value, by comparison with the light-emission periods of the LEDs of the exposure head 34 when forming the image for transfer and formation onto the front side. As a result, as is shown in FIG. 5B, 5C or 5D, the sub-scanning direction length of the image that is formed at the back side of the recording medium is made to match the sub-scanning direction length of the image that has been formed at the front side of the same recording medium. Anyway, in the image formation processing shown in FIG. 6, when the processing of step 132 is performed, the routine proceeds to step 134, and it is judged whether are not printing (transfer and formation of images onto the recording medium) has finished. If this judgement is negative, the routine proceeds to step 136, and it is judged whether or not image formation onto the back side of the recording medium has finished. If it is necessary to carry out image formation onto a next sheet of the recording medium after image formation onto the back side of the recording medium, the judgement of step 136 is positive, the routine returns to step 124, and the processing from step 124 onward is repeated. When image formation onto both sides of an instructed number of recording mediums has been completed, the judgement of step 134 is positive and the image formation processing ends.

Figure 8A:
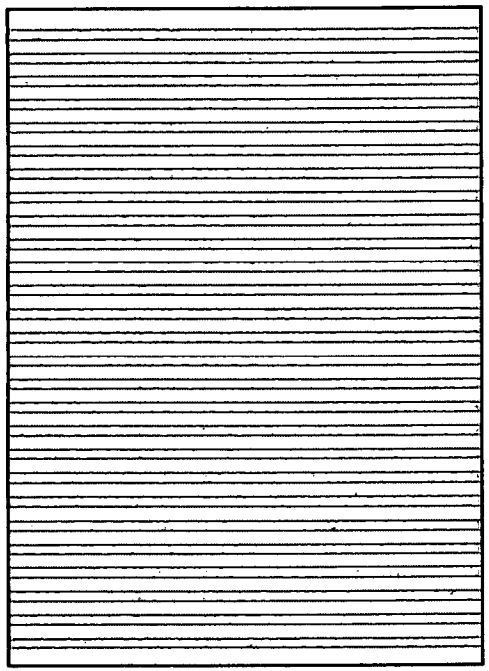
FIG. 8A is an image view showing an example of an image (i.e., of spacings between main-scanning lines) in a case in which there are no variations in density or magnification.
Figure 8B:
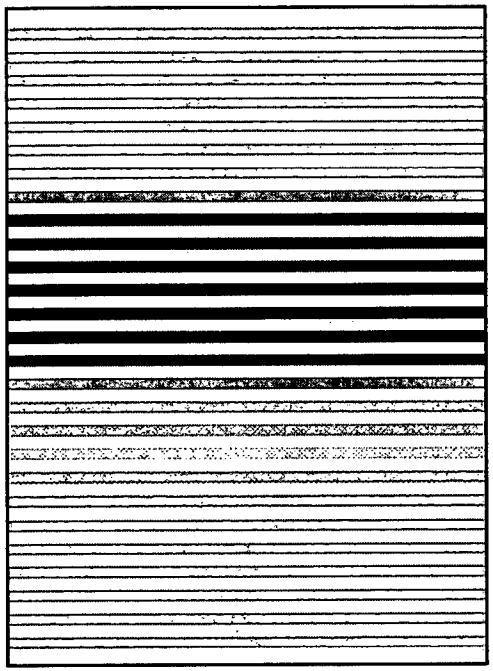
FIG. 8B is an image view showing an example of an image (i.e., of spacings between main-scanning lines) in a case in which there are variations in density and magnification.
Figure 8C:
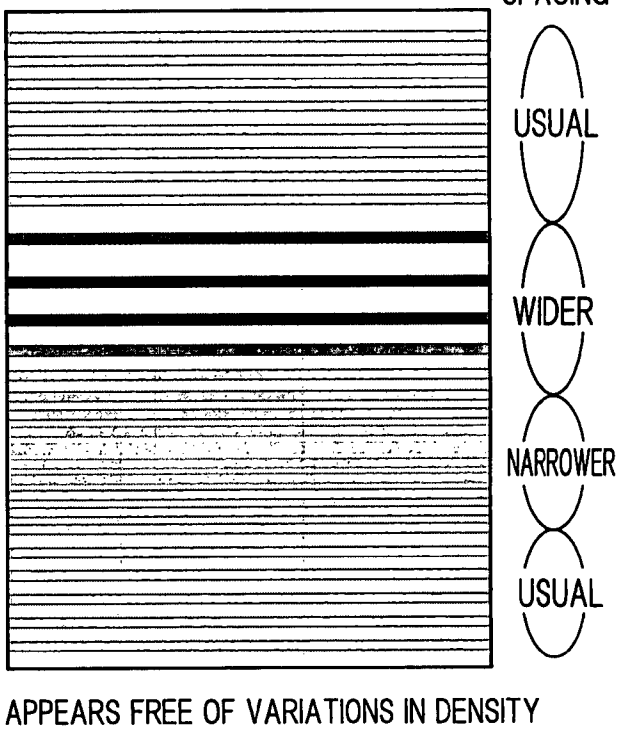
FIG. 8C is an image view showing an example of an image (i.e., of spacings between main-scanning lines) in a case in which light-emission period correction has been applied to the image of FIG. 8B.

Now, the periodic variations within an image of density and/or magnification along the sub-scanning direction, which are caused by eccentricity, inclination and the like of the rotation axis of the photosensitive drum 30, can be eliminated by correcting the light-emission period of the LEDs of the exposure head 34 using the correction data and standard period correction values, which have been written to the memory 74 of the image formation section controller 68 at the time of manufacture of the image formation device 10 as described earlier, and making spacings in the sub-scanning direction of the numerous main-scanning lines which are formed on the peripheral surface of the photosensitive drum 30 constant, as shown in FIG. 8A. However, as use of the image formation device 10 continues, various changes over time occur, such as, for example, changes over time in thickness of a layer at the surface of the photosensitive drum 30, changes over time in developing and processing characteristics of the developing apparatus 36, changes over time of transfer efficiency at the transfer section 38 and suchlike. Hence, because of these various kinds of change over time, even though the spacings in the sub-scanning direction of the numerous main-scanning lines which are formed on the peripheral surface of the photosensitive drum 30 are constant, periodic variations in density and the like will occur along the sub-scanning direction within images, as shown in FIG. 8B.

Figure 9:
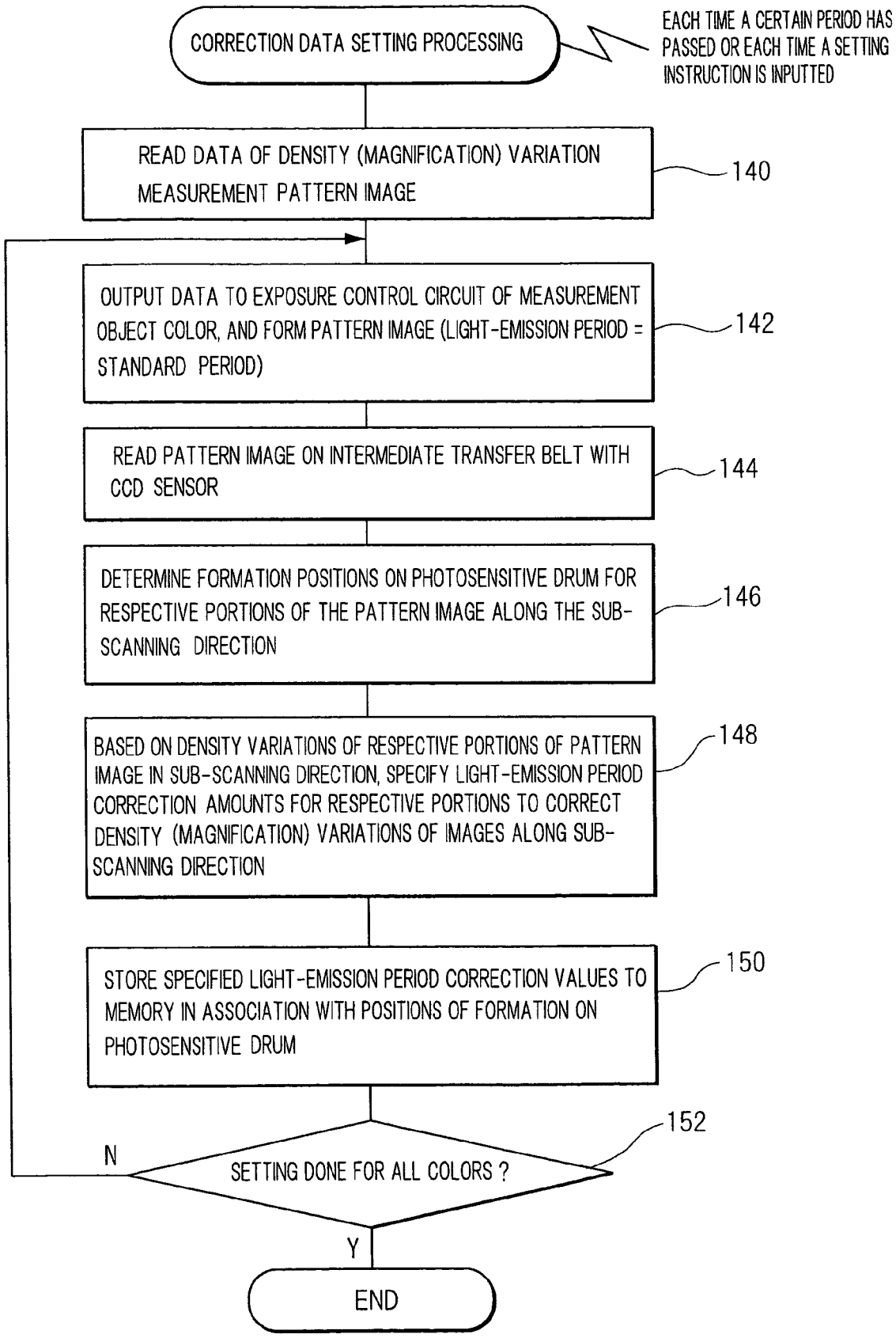
FIG. 9 is a flowchart showing details of correction data setting processing.

Accordingly, at the image formation device 10 relating to this exemplary embodiment, the correction data setting processing shown in FIG. 9 is periodically executed by the CPU 72 of the image formation section controller 68. A timing of execution of this correction data setting processing may be each time a cumulative value of hours of operation of the image formation device 10 subsequent to a previous execution of this processing is reached, and may be each time execution of this processing is instructed from the control panel 14.

In this correction data setting processing, first, in step 140, data for forming a pattern image for density/magnification variation measurement, which has been stored in the memory 74 beforehand, is read out. In this exemplary embodiment, a long strip-form pattern image with a constant density in a range of at least the circumferential length of the photosensitive drum 30 along the sub-scanning direction, as shown in FIG. 2, is used as the density/magnification variation measurement pattern image. In a next step 142, of the colors yellow, magenta, cyan and black, a measurement object color is selected from among colors for which the subsequent processing has not yet been executed. Then, the data of the density/magnification variation measurement pattern image which has been read in step 140 is written to the buffer memory 84 for the exposure control circuit corresponding to the selected measurement object color. Then, data representing 'correction off' and a light-emission period standard value are outputted to serve as correction on/off data and the light-emission period value, respectively, after which formation of the density/magnification variation measurement pattern image is instructed. Hence, a toner image of the density/magnification variation measurement pattern image is formed on the peripheral surface of the photosensitive drum 30 by the exposure control circuit and image formation section corresponding to the measurement object color, and the toner image that has been formed is transferred to the intermediate transfer belt 18.

When a portion of the intermediate transfer belt 18 to which (the toner image of) the density/magnification variation measurement pattern image has been transferred reaches a position at which the CCD sensor 28 is disposed, in a next step 144, the density/magnification variation measurement pattern image on the intermediate transfer belt 18 is sequentially read by the CCD sensor 28. Meanwhile, at the CPU 72, after formation of the density/magnification variation measurement pattern image has been instructed to the exposure control circuit corresponding to the measurement object color, rotation amounts of the photosensitive drum 30 at which the density/magnification variation measurement pattern image is being formed are sensed by monitoring (counting numbers of pulses or the like) the rotation position signals which are inputted via the signal processing circuit 70 from the rotation position detection sensor 64, which detects rotation positions of the photosensitive drum 30. In a next step 146, in accordance with a time at which the reading of the density/magnification variation measurement pattern image by the CCD sensor 28 commences and of rotation amounts of the photosensitive drum 30 in the duration from instructing the formation of the density/magnification variation measurement pattern image until the reading of the density/magnification variation measurement pattern image commences, it is determined which of positions along the sub-scanning direction of the photosensitive drum 30 respective regions along the sub-scanning direction of the density/magnification variation measurement pattern image, which are read by the CCD sensor 28, were formed at.

Here, correction of the light-emission period of the LEDs of the exposure head 34 is not performed while the density/magnification variation measurement pattern image is being formed. Therefore, densities and magnifications of respective portions along the sub-scanning direction of the density/magnification variation measurement pattern image vary because of periodic variations in the perimeter speed of the photosensitive drum 30 which are caused by eccentricity, inclination and the like of the rotation axis of the photosensitive drum 30, in addition to variation components caused by the various changes over time of the image formation device 10. Accordingly, in a next step 148, density variations of respective portions of the density/magnification variation measurement pattern image along the sub-scanning direction are calculated on the basis of the results of reading of the density/magnification variation measurement pattern image by the CCD sensor 28. On the basis of the calculated variations in densities, light-emission period correction amounts (duration values) that will make densities, of respective portions along the sub-scanning direction of the density/magnification variation measurement pattern image, constant are set for respective positions along the rotation direction of the photosensitive drum 30.

Figure 10:
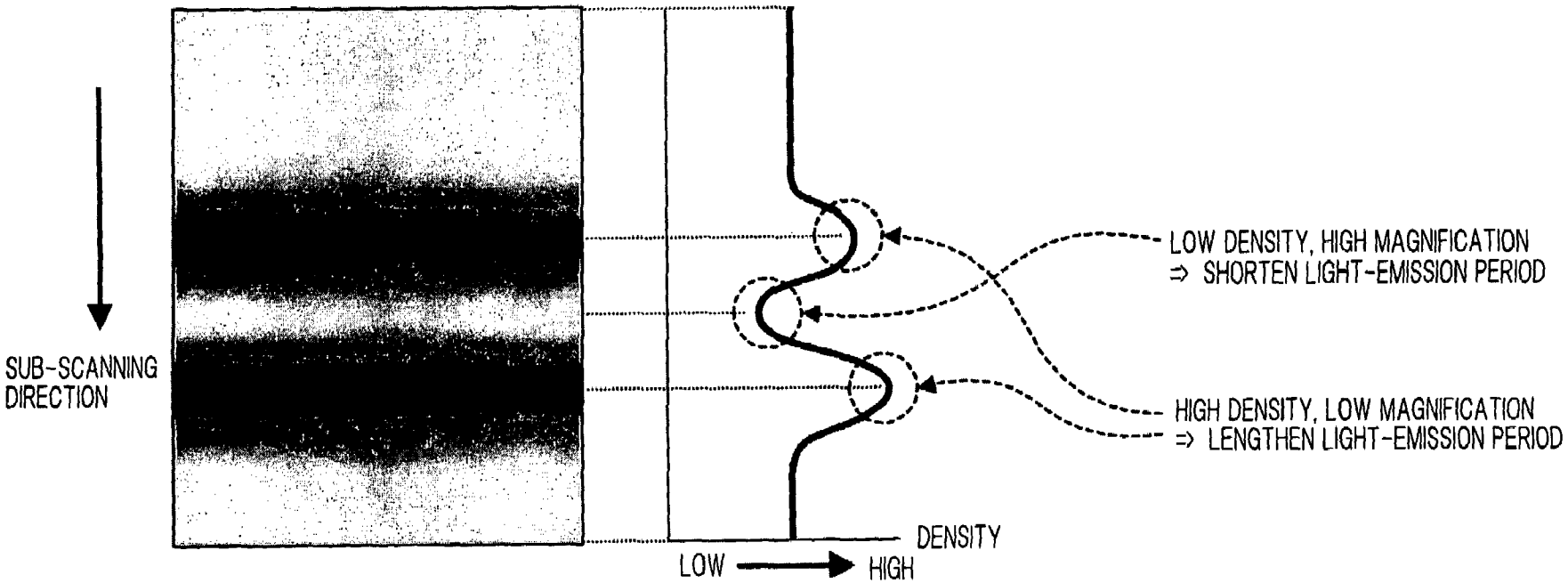
FIG. 10 is an image view and a graph showing an example of density variations in a pattern image for density (magnification) variation measurement.

More specifically, for example, as shown in FIG. 10, for a high-density portion of the density/magnification variation measurement pattern image, at which density is higher than an average density, a light-emission period correction amount for a position, of the respective positions along the rotation direction of the photosensitive drum 30, at which this high-density region was formed is specified so as to make the light-emission period longer in accordance with magnitude of the difference from the average density. Further, for a low-density portion of the density/magnification variation measurement pattern image, at which density is lower than the average density, a light-emission period correction amount for a position, of the respective positions along the rotation direction of the photosensitive drum 30, at which this low-density region was formed is specified so as to make the light-emission period shorter in accordance with magnitude of the difference from the average density. Then, once the setting of the light-emission period correction amounts for the respective positions along the rotation direction of the photosensitive drum 30 has been finished, in order to prevent the sub-scanning direction length of the image changing as a result of the light-emission period corrections, the sizes of the correction amounts are then adjusted as necessary so as to make an average value of the correction amounts zero.

Then, in step 150, correction data for the respective positions along the rotation direction of the photosensitive drum 30 are respectively calculated from the light-emission period correction amounts which have been specified in step 148 for the respective positions along the rotation direction of the photosensitive drum 30. The calculated correction data is written over correction data of the measurement object color which was previously stored at the memory 74 and is stored thereat. In a next step 152, it is judged whether or not the processing from step 142 onward has been performed for each of the colors yellow, magenta, cyan and black. If this judgement is negative, the routine returns to step 142, and steps 142 to 152 are repeated until the judgement of step 152 is positive. Then, when the judgement of step 152 is positive, the correction data setting processing ends.

In this manner, new correction data for correcting variations within an image of density (and magnification) along the sub-scanning direction, which are caused by perimeter speed variations of the photosensitive drum 30 and the various changes over time of the image formation device 10, is stored at the memory 74 for each of the colors yellow, magenta, cyan and black. Hence, at times of image formation, because the light-emission periods of the LEDs of the exposure heads 34 are corrected using this new correction data, variations within images of density (and magnification) along the sub-scanning direction which are caused by, in addition to perimeter speed variations of the photosensitive drum 30, the various changes over time of the image formation device 10 are corrected.

Figure 11:
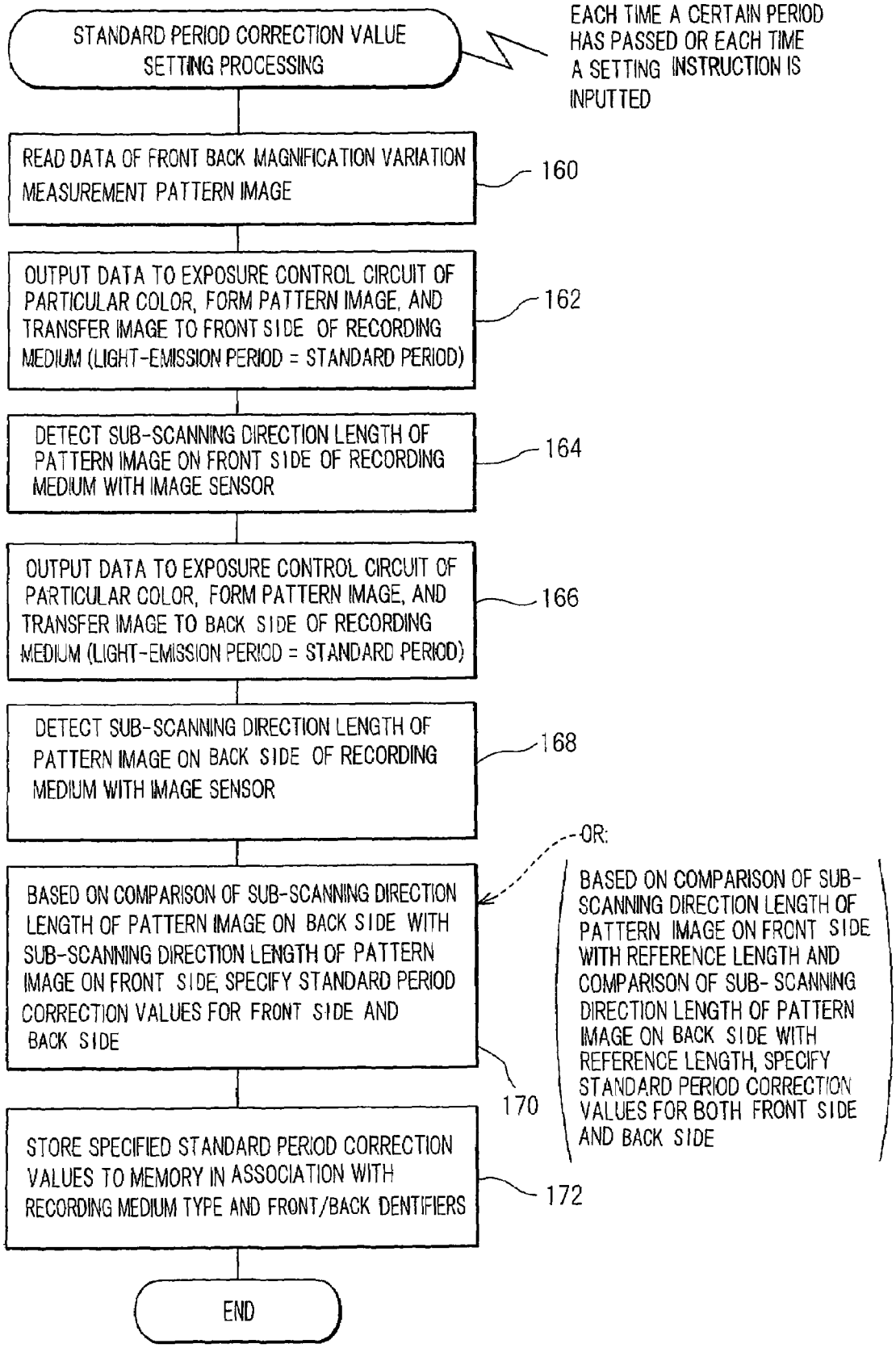
FIG. 11 is a flowchart showing details of standard period correction value setting processing.

The various changes over time at the image formation device 10 may also be expressed as changes in the sub-scanning direction lengths of images which are transferringly formed at the front side and back side of a recording medium. Accordingly, in the image formation device 10 relating to this exemplary embodiment, the standard period correction value setting processing shown in FIG. 11 is periodically executed by the CPU 72 of the image formation section controller 68. A timing of execution of this standard period correction value setting processing may be each time a cumulative value of hours of operation of the image formation device 10, subsequent to a previous execution of this processing for the recording medium of the particular recording medium type that is accommodated in the tray 40, is reached, and/or may be each time execution of this processing is instructed from the control panel 14.

In this standard period correction value setting processing, first, in step 160, data for forming a pattern for front-rear magnification variation measurement, which has been stored in the memory 74 beforehand, is read out. Here, the aforementioned density/magnification variation measurement pattern image may be used as the front-rear magnification variation measurement pattern image, or a dedicated pattern image may be separately prepared. In a next step 162, the data of the front-rear magnification variation measurement pattern image which has been read in step 160 is written to the buffer memory 84 for a particular exposure control circuit. Then, data representing 'correction off' (or possibly 'correction on') and a light-emission period standard value are outputted to serve as correction on/off data and the light-emission period value, respectively, after which formation of the front-rear magnification variation measurement pattern image on the front side of the recording medium is instructed. Hence, a toner image of the front-rear magnification variation measurement pattern image is formed on the peripheral surface of the photosensitive drum 30 by the particular exposure control circuit and the corresponding image formation section. The formed toner image is transferred to the intermediate transfer belt 18, is then transferred to the front side of the recording medium of the particular recording medium type, and is fixed by the fixing apparatus 50. Then, in step 164, a sub-scanning direction length of the front-rear magnification variation measurement pattern image that has been transferred and fixed to the front side of the recording medium is detected by the image sensor 58.

In step 166, the data of the front-rear magnification variation measurement pattern image that was read in step 160 is again written to the buffer memory 84 for the particular exposure control circuit. In addition, data representing 'correction off' (or possibly 'correction on') and the light-emission period standard value are outputted to serve as the correction on/off data and the light-emission period value, respectively, after which formation of the front-rear magnification variation measurement pattern image on the back side of the recording medium is instructed. Hence, a toner image of the front-rear magnification variation measurement pattern image is again formed on the peripheral surface of the photosensitive drum 30 by the particular exposure control circuit and the corresponding image formation section. The formed toner image is again transferred to the intermediate transfer belt 18, is then transferred to the back side of the recording medium of the particular recording medium type, and is fixed by the fixing apparatus 50. Then, in step 168, a sub-scanning direction length of the front-rear magnification variation measurement pattern image that has been transferred and fixed to the back side of the recording medium is detected by the image sensor 58.

In step 170, standard period correction values for the front side and the back side are respectively specified on the basis of a ratio of the sub-scanning direction length of the front-rear magnification variation measurement pattern image that has been transferred and fixed to the back side of the recording medium to the sub-scanning direction length of the front-rear magnification variation measurement pattern image that has been transferred and fixed to the front side of the recording medium. Similarly to the previously described standard period correction amount setting operation, this setting of the standard period correction values can, if the sub-scanning direction length of the image which has been transferred and fixed to the front side of the recording medium serves as a reference, set the standard period correction amount for the front side to 0 (no correction) and set the standard period correction amount for the back side such that the standard period after correction is L1/L2 times the standard period before correction (see FIG. 5B). If the sub-scanning direction length of the image which has been transferred and fixed to the back side of the recording medium serves as a reference, the standard period correction amount for the back side can be set to 0 (no correction) and the standard period correction amount for the front side can be set such that the standard period after correction is L2/L1 times the standard period before correction (see FIG. 5C). Further, if an original sub-scanning direction length (an absolute magnification) of the images serves as a reference, the standard period correction amount for the front side can be set such that the standard period after correction is Lref/L1 times the standard period before correction and the standard period correction amount for the back side can be set such that the standard period after correction is Lref/L2 times the standard period before correction (see FIG. 5D).

Then, in step 172, the front side and back side standard period correction values which have been specified in step 170 are stored to the memory 74 in association with the recording medium type and front-rear identifiers, and the standard period correction value setting processing ends. Thus, new standard period correction values for correcting variations, due to the various changes over time of the image formation device 10, in sub-scanning direction lengths of images which are formed by transfer to front sides and back sides of recording mediums are stored at the memory 74. Hence, at a time of image formation onto both sides of a recording medium, the light-emission periods of the LEDs of the exposure head 34 are corrected using the above-described new standard period correction values. Thus, even if various changes over time of the image formation device 10 would be expressed as changes in the sub-scanning direction lengths of the images that are formed by transfer to the front side and the back side of the recording medium, it is possible to correct the sub-scanning direction lengths of the images to be formed at the front side and back side such that the sub-scanning direction lengths of the images that are formed at the front side and the back side match.

Figure 12:
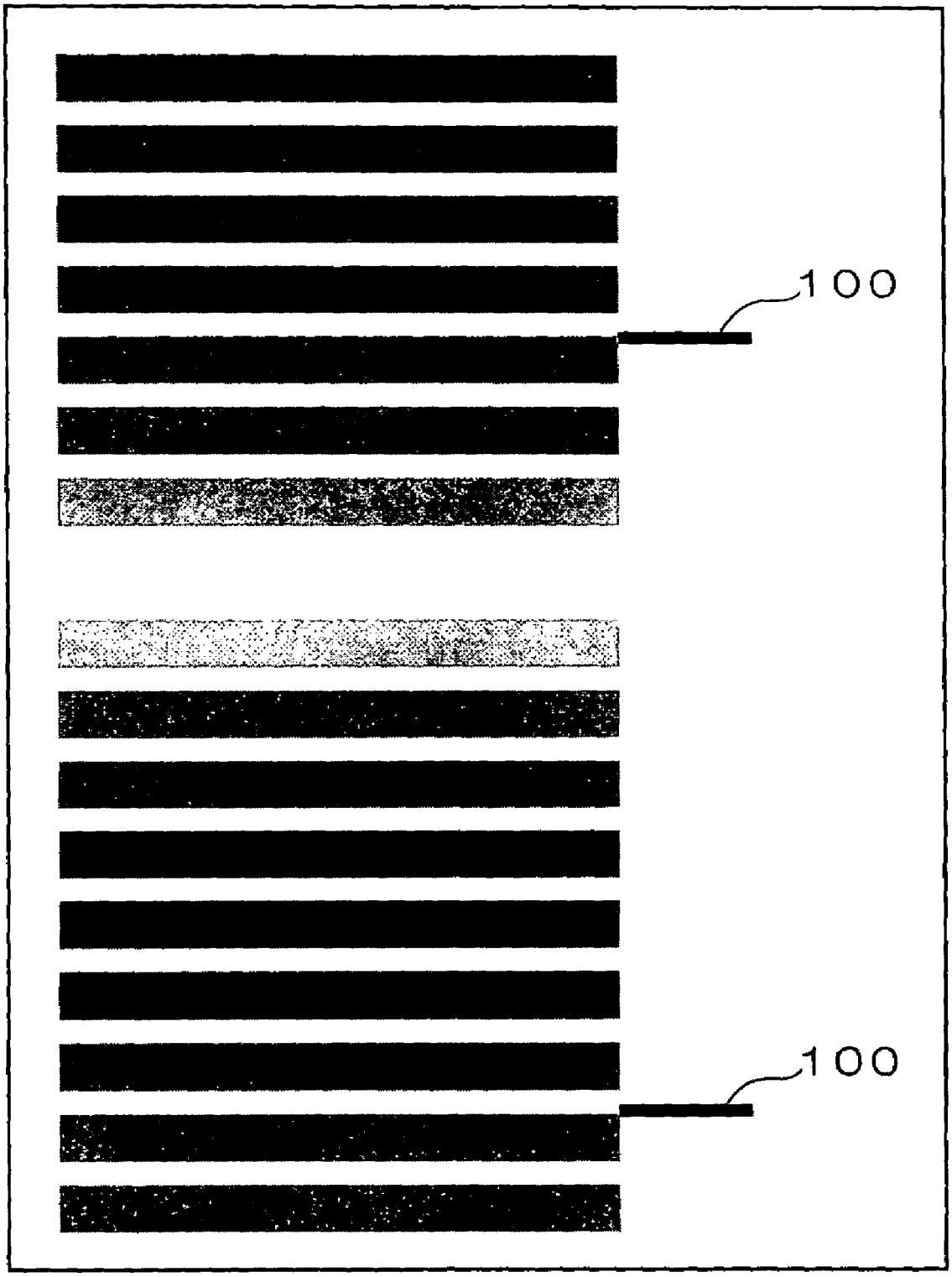
FIG. 12 is an image view showing another example of a pattern image for density (magnification) variation measurement.

Herein, a mode has been described in which reading of the density/magnification variation measurement pattern image for detecting variations in density (magnification) of an image along the sub-scanning direction is performed by the CCD sensor 28 and detection of the sub-scanning direction lengths of the front-rear magnification variation measurement pattern images, for detecting a difference between sub-scanning direction lengths of images that are formed by transfer to the front side and the back side of a recording medium, is performed by the image sensor 58. However, the present invention is not limited thus. It is also possible to perform reading of the respective pattern images with the original-reading apparatus 12 or a scanner separate from the image formation device 10, or the like. However, when reading the density/magnification variation measurement pattern image, it is necessary to determine which of positions along the rotation direction of the photosensitive drum 30 formed respective portions along the sub-scanning direction of the pattern image, whose densities are detected by the reading of the pattern image. In this case, as is shown by an example in FIG. 12, it is possible to add marks 100 to the pattern image in order to identify positions of formation at the photosensitive drum 30 of the respective portions of the pattern image. Hence, even when reading the pattern image with the original-reading apparatus 12 or a scanner separate from the image formation device 10, it is possible to carry out the determination in accordance with the marks 100.

In the correction data setting processing shown in FIG. 9, at a time of formation of the density/magnification variation measurement pattern image, correction on/off data representing 'correction off' is outputted to the exposure control circuit. Therefore, the density/magnification variation measurement pattern image is formed with densities and magnifications of respective portions along the sub-scanning direction varying because of periodic variations in perimeter speed of the photosensitive drum 30, due to eccentricity, inclination and the like of the rotation axis of the photosensitive drum 30, and because of various changes over time of the image formation device 10. Previous correction data is overwritten with new correction data which is found from this density/magnification variation measurement pattern image. However, the present invention is not limited thus. It is also possible to output correction on/off data representing 'correction on' to the exposure control circuit at the time of formation of the density/magnification variation measurement pattern image, and thus to form the density/magnification variation measurement pattern image with the densities and magnifications of the respective portions along the sub-scanning direction varying only because of the various changes over time of the image formation device 10 since a previous time of correction data setting. In such a case, the correction data that is found from this density/magnification variation measurement pattern image (correction data which corrects density and the like according to the various changes over time of the image formation device 10 since the previous time of correction data setting) may be combined with the previous correction data to obtain new correction data.

Further, hereabove, a mode in which the same correction data is used regardless of contents of images that are to be formed at the recording medium has been described. However, the present invention is not limited thus. In a case in which spacings along the sub-scanning direction of main-scanning lines alter in an image which is realized by screen processing, a magnitude of a change in density which is visible can be considered to differ in accordance with a type of screen that is applied to the image (i.e., an angle of the screen, a category of the screen (a linear form, a dot form or the like) or the like). Therefore, particularly in a case in which high accuracy correction of variations in density is considered more important than variations in magnification, correction data may be specified for each of types of screen (or for each of groups of screen types, if screen types are divided into plural groups according to magnitudes of changes in density that are visible). Hence, a type of screen that is used at a time of converting image data to binary data may be acquired from the image processing controller 66, and the correction data switched in accordance with the acquired screen type.

Figure 13A:
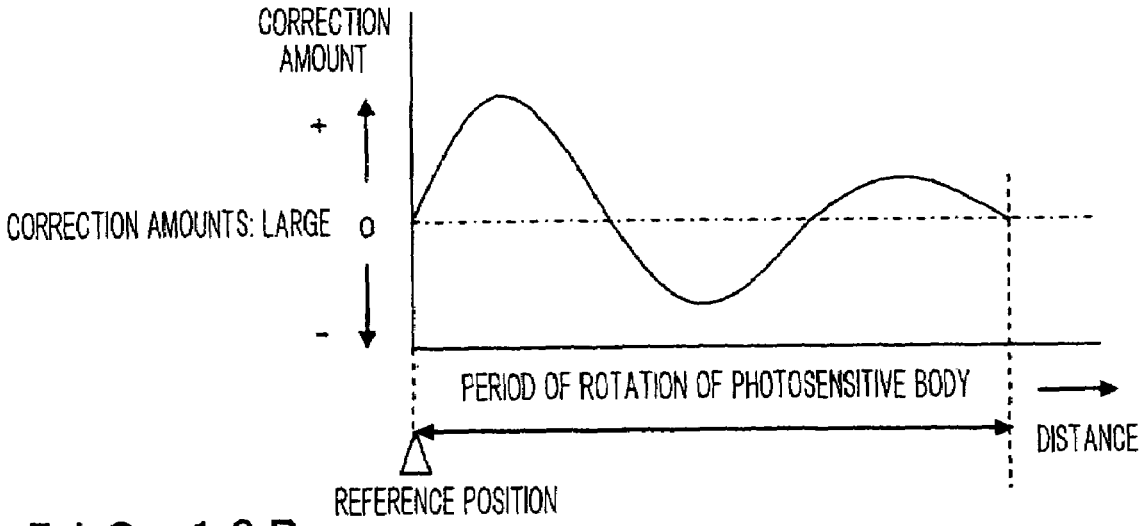
FIGS. 13A, 13B and 13C are graphs showing examples of correction data for respective types of screen (or groups of screen types)
Figure 13B:
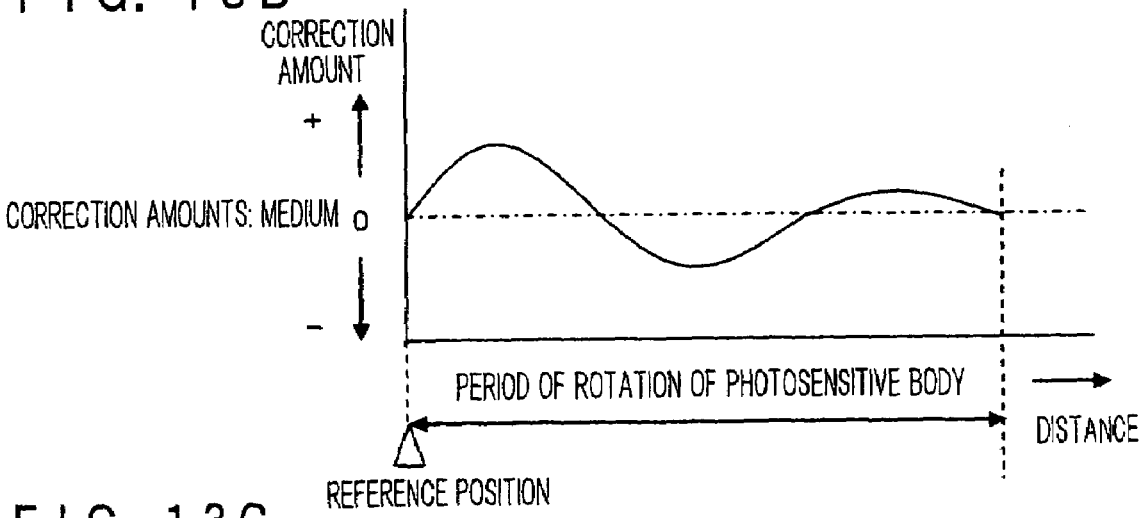
Figure 13C:
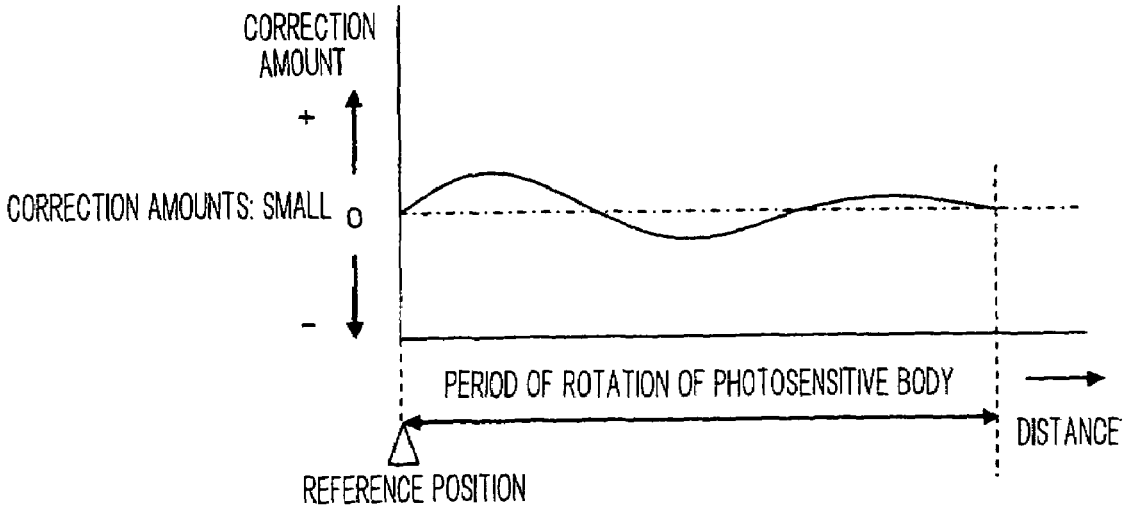

The correction data can be specified for each screen type (or each group of screen types) as described below. For example, when light-emission period correction amounts (the correction data) are found from variations of perimeter speed of the photosensitive drum 30 by the correction data setting operation, a relationship between variation amounts of the perimeter speed of the photosensitive drum 30 and light-emission period correction amounts which can suppress visible changes in density is preparatorily calculated as a correction coefficient for the respective screen type (or the respective group of screen types). Hence, on the basis of variations in the perimeter speed of the photosensitive drum 30 which are measured by the perimeter speed measurement device, it is possible to obtain correction data for each of the screen types (or each of the groups of screen types), with mutually different light-emission period correction amounts, by multiplying with these correction coefficients, as shown by the examples in FIGS. 13A, 13B and 13C.

Figure 14:
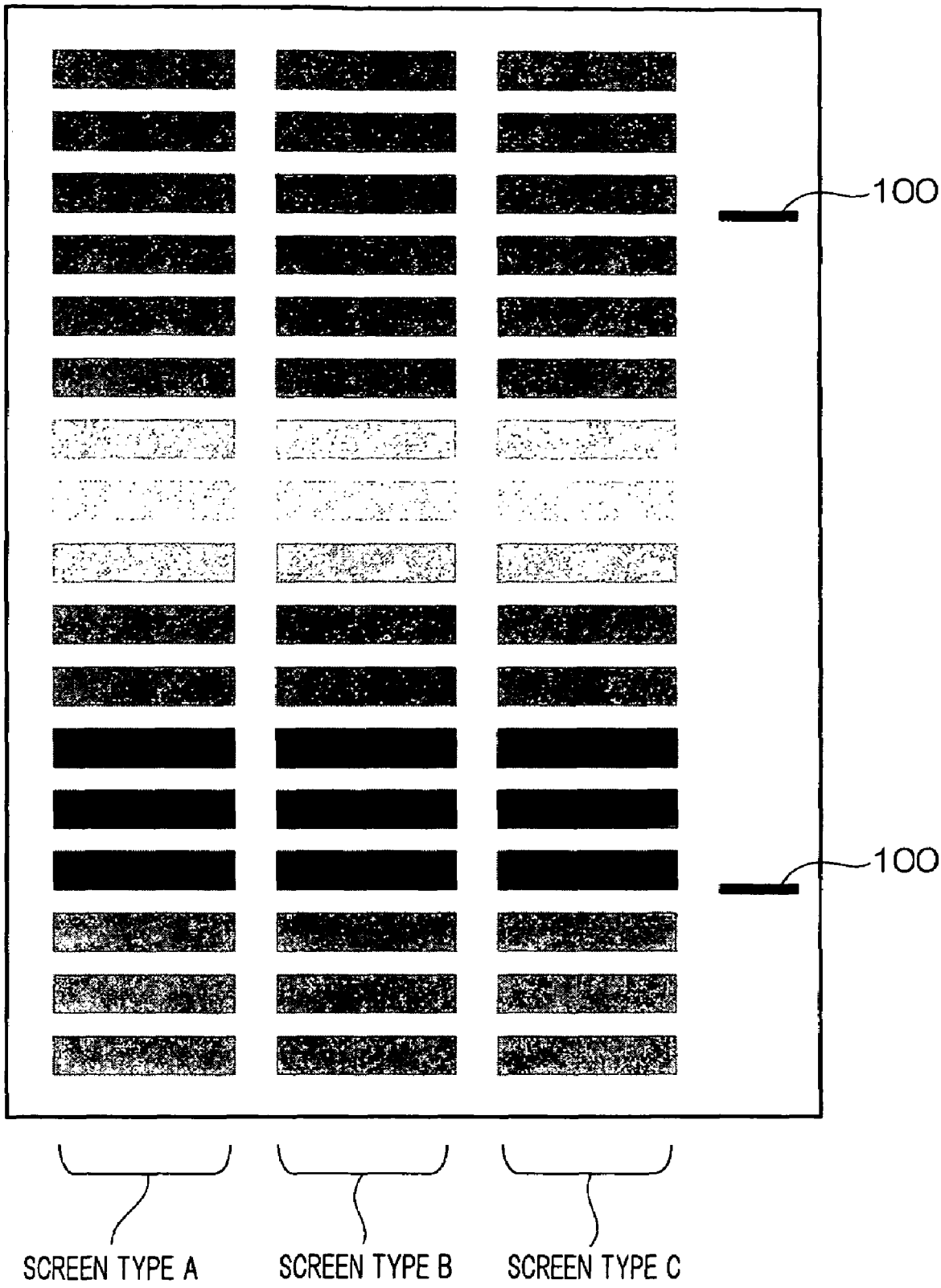
FIG. 14 is an image view showing a pattern image for density (magnification) variation measurement for obtaining correction data for the respective types of screen (or groups of screen types).

Further, when forming the density/magnification variation measurement pattern image and finding light-emission period correction amounts (correction data) by reading the density/magnification variation measurement pattern image, it is possible to preparatorily find a correction coefficient for each screen type (or each group of screen types) in a similar manner to that described above (for example, a correction coefficient which represents a relationship between density variations in the density/magnification variation measurement pattern image and visible density variations in an image of a corresponding screen type), and to obtain correction data for each screen type (or each group of screen types) using these correction coefficients. Further yet, it is possible to use an image which includes plural regions at which screen processing is performed using screens of mutually different screen types, as shown in the example of FIG. 14, as the density/magnification variation measurement pattern image (in FIG. 14, this plural regions are labeled 'screen A', 'screen B' and 'screen C'), to calculate density variations for respective regions along the sub-scanning direction for each region to find the correction data, and thus to obtain correction data for each screen type (or each group of screen types).

Further still, it is common for screens with comparatively high numbers of lines such as, for example, 600 lines, 300 lines or the like to be used for text regions of images, and for screens with low numbers of lines, of the order of, for example, 175 lines or the like, to be used for image regions. Moreover, it is common for regions at which screen processing is performed using screens with mutually different screen types to be mixed within a single image. In consideration of this, it is possible to, for example, plurally provide the correction data memory 86 at each exposure control circuit, and to provide an extra selector, for selecting correction data, between the plurally provided correction data memories 86 and the selector 88. A structure may configured such that the CPU 72 writes respective correction data corresponding to each of the mutually differing screen types (or groups of screen types) to the plural correction data memories 86 provided at the respective exposure control circuits and, of the respective correction data inputted from the pluralities of correction data memories 86, the selectors for correction data selection selectively output correction data corresponding to screen types of image data, which are sequentially inputted from the image processing controller 66, to the selectors 88.

Accordingly, for example, when exposing an image region at which a linear-form screen is used, correction amounts for light-emission periods can be made relatively small, whereas when exposing an image region at which a dot-form screen is used, correction amounts for light-emission periods can be made relatively large. Thus, even in a case in which image regions at which screen processing is performed using screens with mutually different screen types are mixed within a single image, light-emission periods are corrected with correction amounts which are suitable for the screen types of the individual image regions, and it is possible to suitably switch the correction amounts for the light-emission periods so as to respectively correct visible density changes for the respective image regions.

Furthermore, hereabove, a mode has been described in which the same correction amount is outputted as standard period correction values to the exposure control circuits 76 to 82 corresponding to the colors yellow, magenta, cyan and black. However, the present invention is not limited thus. It is also possible to find standard period correction values which will cause the sub-scanning direction lengths of images formed by transfer to the front side and the back side of a recording medium to match separately for each of the colors yellow, magenta, cyan and black (which can be implemented by performing steps 162 to 172 of the standard period correction value setting processing of FIG. 11 for each of the colors), and to output corresponding standard period correction values to the exposure control circuits 76 to 82.

As described above, in an image formation device relating to the present invention, the exposure section is provided, which is equipped with plural light-emitting portions arranged in a first direction, and the exposure section and the image-holding member are relatively moved in a second direction, which crosses the first direction, by the movement section. Herein, an LED head at which plural LEDs are arranged in the first direction to serve as the plural light-emitting portions is suitable as the exposure section. A light-emission control section causes the plural light-emitting portions of the exposure section to periodically emit light in accordance with image data representing an image that is to be formed on the image-holding member, to form the image on the image-holding member. Thus, rows of dots in the first direction (a main scanning direction), which are formed by exposure at each cycle of light-emission by the plural light-emitting portions, are plurally arranged in the second direction (a sub-scanning direction) to form the image, and the image is exposingly formed onto the image-holding member.

Herein, the light-emission control section alters the light-emission period of the plural light-emitting portions during formation of the image so as to correct variations, within the image being formed on the image-holding member, in at least one of density and magnification in the second direction. In accordance with changes in the light-emission period of the plural light-emitting portions, spacings of the dot rows which constitute the image being formed on the image-holding member are locally altered. At a region at which the dot row spacings are enlarged by lengthening the light-emission period, a spatial density of the dots is lowered, and thus the image density decreases and the magnification increases. At a region at which the dot row spacings are reduced by shortening the light-emission period, a spatial density of the dots is lowered, and thus the image density increases and the magnification decreases.

In this manner, it is possible to locally alter the density and/or magnification along the second direction (the sub-scanning direction) within the image by altering the light-emission period of the plural light-emitting portions during formation of the image. Therefore, by altering the light-emission period of the plural light-emitting portions during formation of the image, it is possible to correct periodic variations within the image of the at least one of density and magnification along the sub-scanning direction. Moreover, it is possible to realize this without controlling light-emission light amounts of the plural light-emitting portions, performing control to alter a rotation speed of a rotating member such as a polygon mirror or the like.

Now, in a case in which the image-holding member is a rotating body which is rotated by the movement section and the image is formed at an outer peripheral surface of the image-holding member, the at least one of density and magnification along the sub-scanning direction, in the image that is being formed on the outer peripheral surface of the image-holding member, is altered in accordance with the position of the image-holding member along the direction of rotation of the image-holding member. Accordingly, a position detection section may also be provided, which detects a position of the image-holding member along the rotation direction of the image-holding member.

Further, in a case in which the image-holding member is a rotating body which is rotated by the movement section and the image is formed at the outer peripheral surface of the image-holding member, a perimeter speed of the image-holding member may vary due to eccentricity of the image-holding member or the like. The periodic variations in the at least one of density and magnification along the second direction, in the image which is formed at the outer peripheral face of the image-holding member, have a relationship with periodic variations in the perimeter speed of the image-holding member. Accordingly, the image formation device may further include a perimeter speed detection section, wherein the image-holding member comprises a rotating body, which is rotated by the movement section and includes an outer peripheral surface at which the image is formed, the perimeter speed detection section detects periodic variations in a perimeter speed of the image-holding member, and the light-emission control section alters the light-emission period of the plural light-emitting portions during formation of the image on the basis of results of detection by the perimeter speed detection section, so as to correct periodic variations, of the at least one of density and magnification ratio along the second direction in the image, that occur in accordance with the variations of the perimeter speed of the image-holding member.

Further, a magnitude of density changes when dot spacings along the sub-scanning direction are changed in an image for which screen processing is implemented differs in accordance with a type of screen that is applied to the image. In consideration thereof, the image data used for light-emission of the plural light-emitting portions comprises image data that has undergone screen processing, correction amounts are respectively specified for plural types of screens, and the light-emission control section corrects the light-emission period of the plural light-emitting portions using the correction amounts that correspond to a type of screen that has been applied to the image data.

Further, the periodic variations in the image of the at least one of density and magnification ratio along the second direction are measured by at least one of (a) reading a predetermined pattern image which has been formed on the image-holding member with a reading section, (b) reading the predetermined pattern image with a reading section, the predetermined pattern image having been transferred onto an intermediate transfer body, to which the image is to be first-transferred, (c) reading the predetermined pattern image with a reading section inside the image formation device, the predetermined pattern image having been formed on a recording medium by transfer from the image-holding member or the intermediate transfer body, and (d) reading the predetermined pattern image with a scanner, the predetermined pattern image having been formed by transfer onto the recording medium, which has been ejected from the image formation device. Here, as the above-mentioned predetermined pattern image, it is possible to use an image which includes a long-strip region with a fixed density within a region with a length along the second direction that is at least a predetermined value (for example, if the image-holding member is a rotating body, at least a circumferential length of the image-holding member), such that it is possible to easily measure the periodic variations in the at least one of density and magnification along the second direction.

Further, the variation pattern image with the periodic variations, within the image which is formed on the image-holding member, of the least one of density and magnification along the second direction also changes in accordance with changes over time of portions of the image formation device. However, by automatically at routine intervals executing formation of the predetermined pattern image, or executing the same when instructed, it is possible to obtain an up-to-date variation pattern for the time at which the pattern image with the periodic variations, within the image formed on the image-holding member, of the least one of density and magnification along the second direction is formed. By the light-emission control section altering the light-emission period of the plural light-emitting portions during formation of images on the basis of this up-to-date variation pattern, it is possible to correct a component, of the periodic variations of the at least one of density and magnification along the second direction within the image, that occurs as a result of the changes over time of portions of the image formation device.

Now, contraction of the recording medium in accordance with a temperature change at a time of heating, for example, during fixing processing, is a major cause of a difference in overall magnifications along the second direction between the front side image and the back side image of a recording medium. An amount of such a contraction of the recording medium differs in accordance with a type of the recording medium. In consideration thereof, a memory section may be further provided, which stores the average light-emission periods of the plural light-emitting portions, for when the image is to be formed at the front side and the back side of the recording medium, for each of plural types of recording media, and the light-emission control section reads the average light-emission periods corresponding to a type of recording medium at which the images are to be formed from the memory section, and implements alterations of the average light-emission periods of the plural light-emitting portions.

Furthermore, the present invention can also be realized as a method that causes an image formation device to operate as described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation device comprising:

an image-holding member that an image is formed thereon;

an exposure section, that includes a plurality of light-emitting portions arranged in a first direction;

a movement section, that moves the exposure section and the image-holding member relative to one another in a second direction, that intersects the first direction; and a light-emission control section which causes the plurality of light-emitting portions of the exposure section to periodically emit light in accordance with image data, which represents the image that is to be formed on the image-holding member, and causes the image to be formed on the image-holding member, the light-emission control section altering a light-emission period of the plurality of light-emitting portions during formation of the image so as to correct periodic variations in the image of at least one of density and magnification ratio along the second direction, the periodic variations corresponding with changes in a peripheral velocity of the image-holding member, the changes in the peripheral velocity repeating with a frequency equal to a frequency of the image-holding member.

2. The image formation device of claim 1, further comprising a position detection section, wherein the image-holding member comprises a rotating body, which is rotated by the movement section and includes an outer peripheral surface at which the image is formed, the position detection section detects a position of the image-holding member along a direction of rotation, and the light-emission control section repeatedly causes the plurality of light-emitting portions to emit light with the light-emission period being corrected by correction amounts corresponding to current positions of the image-holding member, which are detected by the position detection section, for correcting the periodic variations in the image of the at least one of density and magnification ratio along the second direction.

3. The image formation device of claim 2, further comprising a memory section, which stores the respective correction amounts to be applied to the light-emission period of the plurality of light-emitting portions for correcting the periodic variations of the at least one of density and magnification ratio, the correction amounts being respectively set for respective positions of the image-holding member along the rotation direction of the image-holding member on the basis of results of preparatory measurement of the periodic variations in the image of the at least one of density and magnification ration along the second direction, wherein the light-emission control section acquires the correction amount corresponding to a current position of the image-holding member, that is detected by the position detection section, by reading the correction amount that corresponds to the current position of the image-holding member from the memory section.

4. The image formation device of claim 1, wherein the light-emission control section alters the light-emission period of the plurality of light-emitting portions during formation of the image such that the light-emission period of the plurality of light-emitting portions is longer in accordance with a location of exposure onto the image-holding member by the exposure section being at least one of (a) a location at which the density along the second direction in the image is higher and (b) a location at which the magnification ratio along the second direction is lower.

5. The image formation device of claim 1, wherein the light-emission control section alters the light-emission period of the plurality of light-emitting portions so as to correct the periodic variations in the image of the at least one of density and magnification ratio along the second direction, and so as not to, in accordance with the correction, alter an average light-emission period of the plurality of light-emitting portions over a duration in which an image of one page on the image-holding member is formed by the plurality of light-emitting portions' periodically emitting light.

6. The image formation device of claim 1, further comprising a perimeter speed detection section, wherein the image-holding member comprises a rotating body, which is rotated by the movement section and includes an outer peripheral surface at which the image is formed, the perimeter speed detection section detects periodic variations in a perimeter speed of the image-holding member, and the light-emission control section alters the light-emission period of the plurality of light-emitting portions during formation of the image on the basis of results of detection by the perimeter speed detection section, so as to correct periodic variations, of the at least one of density and magnification ratio along the second direction in the image, that occur in accordance with the variations of the perimeter speed of the image-holding member.

7. The image formation device of claim 6, further comprising a position detection section that detects a position of the image-holding member along a direction of rotation, wherein correction amounts to be applied to the light-emission period of the plurality of light-emitting portions, for correcting the periodic variations of the at least one of density and magnification ratio, are specified for respective positions of the image-holding member on the basis of results of detection by the perimeter speed detection section of variations of the perimeter speed of the image-holding member over a duration in which the image-holding member rotates once, and the light-emission control section corrects the periodic variations in the image of the at least one of density and magnification ratio along the second direction by repeatedly causing the plurality of light-emitting portions emitting light with the light-emission period being corrected by correction amounts, of the specified correction amounts, that correspond to current positions of the image-holding member, which are detected by the position detection section.

8. The image formation device of claim 1, wherein the image data used for light-emission of the plurality of light-emitting portions comprises image data that has undergone screen processing, correction amounts are respectively specified for a plurality of types of screens, and the light-emission control section corrects the light-emission period of the plurality of light-emitting portions using the correction amounts that correspond to a type of screen that has been applied to the image data.

9. The image formation device of claim 1, wherein the periodic variations in the image of the at least one of density and magnification ratio along the second direction are measured by at least one of (a) reading a predetermined pattern image which has been formed on the image-holding member with a reading section, (b) reading the predetermined pattern image with a reading section, the predetermined pattern image having been transferred onto an intermediate transfer body, to which the image is to be first-transferred, (c) reading the predetermined pattern image with a reading section inside the image formation device, the predetermined pattern image having been formed on a recording medium by transfer from the image-holding member or the intermediate transfer body, and reading the predetermined pattern image with a scanner, the predetermined pattern image having been formed by transfer onto the recording medium, which has been ejected from the image formation device.

10. The image formation device of claim 9, wherein the formation of the predetermined pattern image is executed at least one of (a) automatically at routine intervals, and (b) each time the formation of the predetermined pattern image is instructed from an instruction section.

11. The image formation device of claim 9, further comprising a specification section which specifies correction amounts for the light-emission period of the plurality of light-emitting portions, for correcting the periodic variations in the image of the least one of density and magnification ratio along the second direction, wherein the image-holding member comprises a rotating body that is rotated by the movement section and includes an outer peripheral surface at which the image is formed, marks, for identifying positions of formation on the image-holding member of respective portions of the predetermined pattern image, are added to the predetermined pattern image, and the specification section specifies the correction amounts for respective positions of the image-holding member along the rotation direction of the image-holding member on the basis of (a) periodic variations of the at least one of density and magnification ratio along the second direction in the predetermined pattern image, that are measured with the reading section or scanner, and (b) the positions of formation on the image-holding member of the respective portions of the predetermined pattern image, that are identified by reading the marks with the reading section or scanner.

12. The image formation device of claim 1, further comprising a transfer section that causes images which are sequentially formed on the image-holding member to be sequentially transferred on a front side and a back side of the same recording medium, wherein at least one of (a) a difference of overall magnification ratios along the second direction of a front side image that is formed at the front side of a recording medium by the transfer section, and a back side image, which is formed at the back side of the recording medium, and (b) differences with respect to a reference value of lengths along the second direction of the front side image and the back side image, is measured in advance and, on the basis of the at least one difference, the light-emission control section alters an average light-emission period of the plurality of light-emitting portions, in accordance with whether a side at which the image being formed on the image-holding member is to be formed is the front side or the back side of a recording medium, so as to correct the at least one of the difference of the overall magnification ratios and the differences of the lengths.

13. The image formation device of claim 12, wherein the at least one of the difference of the overall magnification ratios and the differences of the lengths with respect to the reference value is measured by at least one of (a) respectively reading predetermined pattern images with a reading section inside the image formation device, the predetermined pattern images having been formed at the front side and the back side, respectively, of a recording medium by the transfer section, and (b) respectively reading the predetermined pattern images with a scanner, the predetermined pattern images having been formed at the front side and the back side, respectively, of the recording medium, which has been ejected from the image formation device.

14. The image formation device of claim 13, further comprising a calculation section that, on the basis of the at least one of the difference of the overall magnification ratios along the second direction of the front side image and the back side image and the differences with respect to the reference value of the lengths along the second direction of the front side image and the back side image, in which the at least one difference is measured by the predetermined pattern images formed at the front side and the back side of the recording medium being read by the reading section or scanner, respectively calculates average light-emission periods of the plurality of light-emitting portions, for when the image being formed on the image-holding member is to be formed at the front side and the back side of the recording medium, so as to correct the at least one of the difference of the overall magnification ratios and the differences of the lengths along the second direction with respect to the reference value.

15. The image formation device of claim 12, further comprising a memory section, that stores the average light-emission periods of the plurality of light-emitting portions, for when the image is to be formed at the front side and the back side of the recording medium, for each of a plurality of types of recording media, wherein the light-emission control section reads the average light-emission periods corresponding to a type of recording medium at which the images are to be formed from the memory section, and implements alterations of the average light-emission periods of the plurality of light-emitting portions.

16. An image formation method for an image formation device including an image-holding member, an exposure section that includes a plurality of light-emitting portions arranged in a first direction, the method comprising:

moving the exposure section and the image-holding member relative to one another in a second direction, which intersects the first direction; and controlling so as to cause the plurality of light-emitting portions of the exposure section to periodically emit light in accordance with image data, that represents an image that is to be formed on the image-holding member, for forming the image on the image-holding member; and altering a light-emission period of the plurality of light-emitting portions during formation of the image so as to correct periodic variations in the image of at least one of density and magnification ratio along the second direction, the periodic variations corresponding with changes in a peripheral velocity of the image-holding member, the changes in the peripheral velocity repeating with a frequency equal to a frequency of the image-holding member.

17. The image formation method of claim 16, wherein the relative moving comprises rotating the image-holding member, the image-holding member being a rotating body.

18. The image formation method of claim 17, further comprising detecting periodic variations in a perimeter speed of the image-holding member, wherein the controlling comprises altering the light-emission period of the plurality of light-emitting portions during formation of the image on the basis of results of the detecting, so as to correct periodic variations, of the at least one of density and magnification ratio along the second direction in the image, that occur in accordance with the variations of the perimeter speed of the image-holding member.

19. The image formation method of claim 17, further comprising detecting a position of the image-holding member along a direction of rotation, wherein the controlling comprises correcting the periodic variations in the image of the at least one of density and magnification ratio along the second direction by repeatedly causing the plurality of light-emitting portions to emit light with the light-emission period being corrected by correction amounts corresponding to current positions of the image-holding member, which are detected in the detecting.

20. The image formation method of claim 16, further comprising sequentially forming images having been sequentially formed on the image-holding member to be sequentially formed on a front side and a back side of a same recording medium, wherein at least one of (a) a difference of overall magnification ratios along the second direction of a front side image, which is formed at the front side, and a back side image, which is formed at the back side, and (b) differences with respect to a reference value of lengths along the second direction of the front side image and the back side image, is measured in advance, and the controlling comprises, on the basis of the at least one difference, altering an average light-emission period, in accordance with whether a side at which the image being formed on the image-holding member is to be formed is the front side or the back side of the recording medium, so as to correct the at least one of the difference of the overall magnification ratios and the differences of the lengths.

21. An image formation device comprising:

an image-holding member on which an image is formed;

an exposure section that includes a plurality of light-emitting portions arranged in a first direction;

a movement section that moves the exposure section and the image-holding member relative to one another in a second direction, that intersects the first direction;

a light-emission control section that causes the plurality of light-emitting portions of the exposure section to periodically emit light in accordance with image data, which represents the image that is to be formed on the image-holding member, and causes the image to be formed on the image-holding member, the light-emission control section altering a light-emission period of the plurality of light-emitting portions during formation of the image so as to correct periodic variations in the image of at least one of density and magnification ratio along the second direction; and a transfer section that causes images that are sequentially formed on the image-holding member to be sequentially transferred on a front side and a back side of the same recording medium, wherein at least one of (a) a difference of overall magnification ratios along the second direction of a front side image that is formed at the front side of a recording medium by the transfer section, and a back side image, which is formed at the back side of the recording medium, and (b) differences with respect to a reference value of lengths along the second direction of the front side image and the back side image, is measured in advance and, on the basis of the at least one difference, the light-emission control section alters an average light-emission period of the plurality of light-emitting portions, in accordance with whether a side at which the image being formed on the image-holding member is to be formed is the front side or the back side of a recording medium, so as to correct the at least one of the difference of the overall magnification ratios and the differences of the lengths.

22. The image formation device of claim 21, wherein the at least one of the difference of the overall magnification ratios and the differences of the lengths with respect to the reference value is measured by at least one of (a) respectively reading predetermined pattern images with a reading section inside the image formation device, the predetermined pattern images having been formed at the front side and the back side, respectively, of a recording medium by the transfer section, and (b) respectively reading the predetermined pattern images with a scanner, the predetermined pattern images having been formed at the front side and the back side, respectively, of the recording medium, which has been ejected from the image formation device.

23. The image formation device of claim 22, further comprising a calculation section that, on the basis of the at least one of the difference of the overall magnification ratios along the second direction of the front side image and the back side image and the differences with respect to the reference value of the lengths along the second direction of the front side image and the back side image, in which the at least one difference is measured by the predetermined pattern images formed at the front side and the back side of the recording medium being read by the reading section or scanner, respectively calculates average light-emission periods of the plurality of light-emitting portions, for when the image being formed on the image-holding member is to be formed at the front side and the back side of the recording medium, so as to correct the at least one of the difference of the overall magnification ratios and the differences of the lengths along the second direction with respect to the reference value.

24. The image formation device of claim 21, further comprising a memory section, that stores the average light-emission periods of the plurality of light-emitting portions, for when the image is to be formed at the front side and the back side of the recording medium, for each of a plurality of types of recording media, wherein the light-emission control section reads the average light-emission periods corresponding to a type of recording medium at which the images are to be formed from the memory section, and implements alterations of the average light-emission periods of the plurality of light-emitting portions.

25. An image formation method for an image formation device including an image-holding member, an exposure section that includes a plurality of light-emitting portions arranged in a first direction, the method comprising:

moving the exposure section and the image-holding member relative to one another in a second direction, which intersects the first direction;

controlling so as to cause the plurality of light-emitting portions of the exposure section to periodically emit light in accordance with image data, that represents an image that is to be formed on the image-holding member, for forming the image on the image-holding member;

altering a light-emission period of the plurality of light-emitting portions during formation of the image so as to correct periodic variations in the image of at least one of density and magnification ratio along the second direction; and sequentially forming images having been sequentially formed on the image-holding member to be sequentially formed on a front side and a back side of a same recording medium, wherein at least one of (a) a difference of overall magnification ratios along the second direction of a front side image, which is formed at the front side, and a back side image, which is formed at the back side, and (b) differences with respect to a reference value of lengths along the second direction of the front side image and the back side image, is measured in advance, and the controlling comprises, on the basis of the at least one difference, altering an average light-emission period, in accordance with whether a side at which the image being formed on the image-holding member is to be formed is the front side or the back side of the recording medium, so as to correct the at least one of the difference of the overall magnification ratios and the differences of the lengths.

* * * * *